US006290319B1

(12) United States Patent
Boleda et al.

(10) Patent No.: US 6,290,319 B1
(45) Date of Patent: Sep. 18, 2001

(54) CONTROLLING RESIDUAL FINE ERRORS OF DOT PLACEMENT IN AN INCREMENTAL PRINTER

(75) Inventors: Miquel Boleda; Guillaume Montaclair; Francisco-Javier Pozuelo, all of Sant Cugat del Valles (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/253,494

(22) Filed: Feb. 19, 1999

(51) Int. Cl.[7] ..... B41J 29/393
(52) U.S. Cl. ..... 347/19; 347/39
(58) Field of Search ..... 347/19, 37, 39; 346/139; 400/279, 283, 74, 323, 709

(56) References Cited

U.S. PATENT DOCUMENTS 5,825,378 * 10/1998 Beauchamp ..... 347/19
6,099,112 * 8/2000 Olazabal ..... 347/85
6,137,592 * 10/2000 Arquilevich et al. ..... 358/1.8
6,158,344 * 12/2000 Walker et al. ..... 347/16

* cited by examiner

*Primary Examiner*—John Barlow
*Assistant Examiner*—Ly T Tran
(74) *Attorney, Agent, or Firm*—Ashen & Lippman

(57) ABSTRACT

A memory holds calibration data that are applied to compensate imperfections in a printhead-carriage guide rod, improving alignment between marks printed with different heads. Commonly heads and a carriage encoder are spaced from the rod at different distances, which interact with rod deviation to form dot-placement errors (DPE) that vary along the rod. The memory holds a single offset value, best a weighted composite of (a) an average of maximum and minimum deviations from straightness, and (b) median deviation, along the rod; or as the carriage moves on the rod the system steps or interpolates between successive offsets, or uses a continuous corrective-offset function. Separate offsets may be stored for adjacent-head pairs. The memory is best a digital unit holding just a few data bits, but may be a mechanical cam or linkage, compensation network or other analog circuit, polynomial coefficients, or codestrip with unequally spaced graduations. A custom strip is used with no further intervention. Calibration data in other memory types are used to modify interhead alignment, carriage-encoder signals, carriage position/speed, printhead-actuation timing or marking rapidity—or image-data position values, color-plane alignment, or pixel structure. Calibration may be prepared by measuring rod-straightness deviations, calculating expectable DPEs between mark pairs made by different heads, and from these finding the needed numbers for storage. Measuring may use conventional instruments but preferably the printer prints patterns (e.g. alternating marks made by two outboard heads) and measures them with an internal sensor. In existing systems—with interhead alignment set in a limited rod segment—the offset is found by comparing DPE ranges over the whole length vs. that segment.

27 Claims, 15 Drawing Sheets

CONTROLLING RESIDUAL FINE ERRORS OF DOT PLACEMENT IN AN INCREMENTAL PRINTER

RELATED PATENT DOCUMENTS

Closely related documents are coowned U.S. utility U.S. Pat. Nos. 4,789,874 of Majette, 5,426,457 of Raskin, 5,600,350 of Cobbs et al., 5,796,414 of Sievert et al., and U.S. patent application Ser. No. 09/024,976 of Maher; as well as applications of Castaño et al. and Boleda et al., both filed generally contemporaneously with this document and respectively entitled "A correction system for droplet placement errors due to printhead to media spacing variation" and "A correction system for droplet placement errors in the scan axis, in . . . inkjet printers". The first-mentioned of these two documents (Castaño) is to be initially filed in the United States Patent and Trademark Office as Ser. No. 09/259,070. The second-mentioned of these two documents (Boleda) was first filed in the European Patent Office as serial 99103185.7 and subsequently filed in the United States Patent and Trademark Office and assigned Ser. No. 09/506,703. All these documents are hereby incorporated by reference in their entirety into the present document.

FIELD OF THE INVENTION

This invention relates generally to machines and procedures for incremental printing of images (which may include text) in two-dimensional pixel arrays, and more particularly to a scanning-printhead machine and method that construct such images from individual colorant spots created on a printing medium, in row-and-column pixel arrays. The invention corrects small, systematic errors in colorant-spot placement that are important in regard to coordination of marks made by different printheads—e.g., in different colors. In some special cases these errors are also significant as to absolute positioning.

The problem solved by the invention, and also the invention itself, will be discussed in terms of thermal-inkjet printing. A person skilled in the art, however, will appreciate that both are applicable to certain other types of incremental printers.

BACKGROUND OF THE INVENTION

1. Importance of Placement Accuracy

Thermal-inkjet printing is based on accurate ballistic delivery of small ink droplets to exact locations on paper or some other printing medium. Ordinarily the droplet placement is with respect to a grid of specified resolution, most common grids nowadays being 12-by-12 or 24-by-24 dots per millimeter (300-by-300 or 600-by-600 dpi). Other possibilities are continuously being considered.

One key requirement for sharp, high-quality images is accuracy of the droplet placement. Drop-placement error (DPE) causes line discontinuity and roughness—especially important in plotters used primarily for computer-aided design (CAD)—as well as banding and color inconsistencies that are significant in printers mainly used to reproduce graphics or photos.

2. Previously Recognized Error Sources, and Solutions

There are several contributors to droplet-placement inaccuracies. Some of these arise in the printhead, and others in the printer mechanism proper; inaccuracies can occur along the scan-axis or paper-axis direction. Some inaccuracies are systematic, while others follow random patterns.

The previously mentioned Majette patent is representative of earlier innovations in encoder subsystems that enable basic determination and servocontrol of printhead position and speed. The Raskin patent teaches how to operate the timing of bidirectionally scanning systems to provide consistent dot placement independent of scanning direction.

The Cobbs and Sievert patents address a still more sophisticated problem, namely control of the mutual alignment of multiple printheads operating on a common scanning carriage. That challenge is met by printing and reading test patterns, to determine the mechanical relationship between the heads on the carriage—and then by, in effect, shifting the operational nozzle arrays on certain of the pens to obtain alignment within specifications.

To facilitate the shifting process, heads are provided with a few extra nozzles at each end, so that the shift is reduced to merely a selection and renaming process. The patents to Cobbs and to Sievert make use of relatively small test patterns automatically printed, and then automatically read.

Other reported efforts make use of laser-based measurements for interpen alignment. This approach likewise is based on measurements taken in a limited-width portion of the printer image space.

3. Newly Discovered Error Mode

Despite these advances, residual errors in interhead alignment have been detected in a current generation of printer/plotters. These errors have an adverse effect on print quality, most conspicuously taking the form of cyan-to-black misalignment in certain portions of standard test images—for instance, particularly where a cyan background appears at one side of a black area fill.

Appearance of these residual errors has been markedly erratic—not arising in every prototype unit but only some units, and also not consistent in all parts of the printed images but rather only within some regions. Furthermore these errors are more severe for some printheads (i.e., certain colors) than others.

On most papers the error appears where vertical lines change color from black to cyan. Also, in plots containing black area fills adjacent to green or violet areas, a certain yellow halo (when green) or magenta halo (when violet) can be seen on misalignments of two pixel columns. In addition these errors are believed to cause higher graininess, mainly in gray area fills.

Awareness of this peculiarity arose in late phases of a product development. As far as we know, no previous worker in this field has attempted to develop an understanding of these mysterious and stubbornly persistent error residuals.

Not only the correction of these defects but also a first recognition of their basic character has only now been revealed. Accordingly a description of the source of these errors is not properly a part of this background section in the present document, and therefore is reserved for a following section summarizing the invention.

A somewhat analogous or related problem of bringing pen-to-paper distance within specifications is treated in the Maher, Castano and Boleda applications mentioned earlier.

4. Conclusion

Small and seemingly erratic dot-placement errors have heretofore impeded achievement of uniformly excellent inkjet printing. Thus important aspects of the technology used in the field of the invention remain amenable to useful refinement.

SUMMARY OF THE DISCLOSURE

The present invention introduces such refinement. Before offering any relatively rigorous outline of the invention itself, however, this summary will begin with a brief informal indication of the nature and source of the elusive errors described above. It is to be understood that this preliminary presentation is not necessarily a statement of the invention as such.

The present invention has proceeded from discovery that the noted residual errors actually are consistent within respective different segments of the scanning sub-system. Furthermore it has been found that the errors are not strictly limited to differential errors between printheads but also extend to absolute errors, as measured by the encoder subsystem.

With these recognitions, the residuals have been traced to imperfections in the printhead-carriage support and guide subsystem. These imperfections directly cause rotations of the carriage relative to the printing medium, and the rotations degrade the relationships between the actual interhead distances and the encoder-measured carriage excursions.

Moreover these same rotations impair the absolute relationship between the actual and measured head positions. The absolute positioning error, since it does not make itself conspicuous in misalignment of marks made by different heads (i.e., marks of different colors) is less important in most applications—but can be significant in special cases when drawings are precisely scaled to provide dimensional analysis of illustrated features.

Specifically the support and guide subsystem includes a rod along which the printhead carriage slides, and a base or so-called "beam" that supports that rod. These components are subject to imperfections in straightness.

In particular the rod has very fine horizontal curvatures—that is, waviness in the horizontal plane, generally parallel to the plane of the printing medium in the printzone—and also in the vertical plane, perpendicular to the plane of the medium. The carriage when translated along the rod accordingly also undergoes very small rotations, respectively about a vertical axis z and about a horizontal axis parallel to the printing-medium advance direction x. (In engineering convention, in this field, the advance direction is more commonly designated "y"; however, for present purposes the notation x will follow that more often seen in the patent literature.)

Rotations in the third dimension (about the axis of the bar) are also possible. These "Theta-Y" (θy) rotations implicate the straightness and parallelism of yet another component—a follower bar—as well as the support/guide rod, and they have a different kind of significance.

Because all the pens are very nearly both at a common height and along a common fore-to-aft contour (relative to the print-medium advance direction), θy displacements of the resulting image features on the printing medium tend strongly to be equal as among the heads (and colors). Absolute displacements, as measured by the encoder, do remain; as mentioned above, these are important only in special cases in which, for example, later systems scale the drawings.

Also resulting from θy rotations, however, are disturbances of the pen-to-paper spacing, and these can be very important. Although pen-to-paper spacing may appear to be greatly disturbed in FIGS. 1 through 5, this is due only to the radical exaggeration of rod curvature in the drawings. (The present invention, however, does correct for interpen effects due to variation in pen-to-paper spacing.)

In the case of θy rotation, disturbance of pen-to-paper spacing is significant. It is addressed in a mechanical solution, for short-stroke carriages of desktop printers, by the above-mentioned Maher document—and also in a calibration approach by the Castano and Boleda documents. The present invention is not (except as to interpen effects) directed to θy corrections.

In this document the first two rotations identified above are respectively called "Theta-Z" (θz) and "Theta-X" (θx) rotations. Although the printheads in current systems are rather close to the rod axis, it is desirable to mount the encoder at a considerable distance from that axis (and on the opposite side of that axis from the printheads). As a result, the encoder-measured translations of the heads can be magnified by the distance from axis to encoder.

For a graphical demonstration of the principle, the sensor and printheads on their carriage are represented diagrammatically in plan by six lines (FIG. 1). The two shortest solid lines C, K represent the positions of the two printheads (cyan and black) that are farthest apart on the carriage (separated by the distance D).

Between these outboard heads C, K, the dashed lines M, Y represent the two inboard heads (magenta and yellow). The long line 101 joining their bases represents the carriage itself. Normally the printheads project forward from the carriage; the front of the printer, in this plan view, is therefore at the top of the diagram.

The two ends 102, 103 of that long line 101 represent the bearing points that engage the support/guide rod and thereby define its position. The medium-length line EB extending away from the carriage in the opposite direction is the infrared-light beam of the encoder, projected between the infrared source and its sensor.

Partway along that path, when the carriage assembly is installed in the printer, the infrared encoder beam EB intersects the encoder strip ES—whose graduations thus modulate the infrared beam to provide position and speed indications. The small circle 104 at the end of the right-hand "printhead" line designates that printhead as an active head, and represents an inkdrop ejected to form a spot on the printing medium at (in this simplified representation) that instantaneous position of the head.

With the curvature of the rod 110 (FIG. 2) magnified, still in a top plan view, it can be seen that translation of the carriage assembly to successive positions also carries the assembly through rotations about the z axis, i.e. $\theta_Z$ rotations as noted earlier. It is the interaction of these rotations with the different distances from the rod axis to the heads and encoder strip, respectively, that causes the error residuals which are the target of the present invention.

The diagram shows what happens when the carriage assembly operates in a region where the guide rod 110 has a curvature that is concave toward the front of the printer (i.e., concave downward as drawn). The carriage is assumed to be traveling from left to right.

It is in a first position (shown in the solid line, with the two intermediate heads omitted for clarity of the drawing) when the right-hand head K fires a first inkdrop 104 (black, in the example) at position 108. The image requires precisely overprinting a second inkdrop 105 (cyan, continuing the same example) from the left-hand head C.

To accomplish this, in principle the carriage should be advanced rightward by the distance D between the left- and right-hand printheads C, K—or, in other words, the carriage should advance until the encoder has counted D units along the encoder strip ES. When this is done, so that the carriage assembly is in a second position (shown in the dashed line) further to the right, the left-hand head C is in position to fire its inkdrop at position 109.

That position, however, is not aligned with position 108 of the previously fired black drop. Rather, the position 109 of the cyan drop is to the left of the black drop, by an error distance Δ.

Due to the carriage rotation—and the fact that the encoder strip ES is further from the guide-rod axis 110 than are the heads C, K—the encoder-beam EB intersection point with the strip ES moves faster than the heads, and has advanced farther along the ideal geometrical scan axis than the heads have. The effect would be opposite near the right side of the drawing, where the rod curvature is convex downward (i.e. again toward the front of the printer).

The effect would also be opposite if the encoder strip ES' (FIG. 3) were on the same side of the rod as the heads, but still far from the rod axis. The target position 108 would be unmoved—but now the beam-strip intersection point would move more slowly than the heads. To shift the beam-strip intersection point 106' by the same distance D, to a new position 107', would now require moving the carriage and heads by a greater distance along the ideal scan axis. The new position 109' of the left-hand (cyan) head would now be to the right of the black drop 108, by a new error distance Δ'.

This arrangement, illustrated merely to more fully clarify the relationships involved, appears to be of only academic interest: it would either place the encoder strip ES' in an undesirably exposed position near the front of the apparatus or place the printheads in an undesirably obstructed position behind the rod. In another geometry of only theoretical interest (FIG. 4), the error Δ"is reduced nearly to zero by placing the encoder strip and printheads roughly equidistant from the rod axis.

Since all such solutions appear impractical, the present invention preferably attacks the source of errors as a matter of calibration. The tiny horizontal curvatures along the rod, or their θz effects on print alignment, can be measured and compensated in operation of the printer.

Analogous curvatures 34C (FIG. 5) in the vertical plane cause the carriage 20, 20' to undergo θx rotations as it moves along the guide rod 34—tipping to left (as shown) or right, and so introducing errors related to differing heights of (1) the printheads 23–26 and (2) the points represented in the drawing by targets 333, 333' where the sensor 233, 233' reads the encoder strip 33, respectively below and above the rod axis. These variations too are correctable by a calibration approach.

It can now be appreciated that the inventions of Cobbs and Sievert—making use of test patterns that are rather small—can be (and usually are) actually slightly misleading. Because the test patterns are small, they are necessarily printed and measured in only a narrow region of the carriage stroke. The same is true of the laser-based measurements mentioned earlier.

Even these readings and corrections are in error when the interpen alignment behavior varies differently over the full operating range of the carriage than it does within that narrow region used to acquire data for interpen alignment. Such narrow-region-based interpen alignment, however, is well-embedded in the hardware and operating procedures (including ASICs) of several products. Because of this history—and associated waste of ink, print media and user time—it would be costly to change.

Now with the foregoing rough introduction in mind, this discussion will turn to a more-formal summary of the present invention. In its preferred embodiments, the invention has several aspects or facets that can be used independently, although they are preferably employed together to optimize their benefits.

In preferred embodiments of a first of its facets or aspects, the invention is apparatus for printing desired images on a printing medium, by construction from individual marks formed in pixel column-and-row arrays. The apparatus includes at least one printhead for marking on the printing medium, and a carriage holding the printhead.

Also included is a rod supporting the carriage for scanning motion across the printing medium. In addition the apparatus includes a printing-medium advance mechanism for providing relative motion between the printhead and printing medium along a direction substantially orthogonal to the rod.

The apparatus of this first aspect of the invention also includes a memory for storing rod-straightness calibration data. Further included are some means for reading from the memory—and applying—the rod-straightness calibration data to compensate in operation of the printhead for imperfection in straightness of the rod.

The foregoing may constitute a description or definition of the first facet of the invention in its broadest or most general form. Even in this general form, however, it can be seen that this aspect of the invention significantly mitigates the difficulties left unresolved in the art.

In particular, the invention enables an incremental printing system to explicitly take account of errors in rod straightness. In this way it potentially corrects the previously described complete vulnerability of incremental printers to such errors.

Although this aspect of the invention in its broad form thus represents a significant advance in the art, it is preferably practiced in conjunction with certain other features or characteristics that further enhance enjoyment of overall benefits.

For example, it is preferred that the apparatus also include an encoder for determining position and speed of the carriage. In this case the invention is particularly useful in product designs wherein the printhead and encoder are at respective opposite sides of the rod.

It is also preferred that the apparatus have a substantially single offset value stored in the memory for use in compensating operation of the printhead along substantially the entire length of the rod. The first use of the word "substantially" here allows for the possibility that more than one offset value may be included, merely for a relatively incidental purpose such as use in certain extreme-performance portions of the operating range, or merely to avoid certain of the appended claims.

The second use of the word "substantially" allows for the possibility that the offset value (or values) are not applied in end zones of the rod—i.e., outside the printing zone—or in particular along parts of the rod, such as the ends, where departure from straightness is most extreme. In accordance with the present invention, however, it is preferred to apply corrections throughout the printing zone and particularly at the ends, since misregistration along image edges tends to be particularly conspicuous.

It is desirable to store such a substantially single offset value, even if error is present in more than one straightness dimension—e.g., most typically two orthogonal dimensions (one vertical and one horizontal). (That is because straightness error in both such directions, and interpen variations in pen-to-paper spacing as well, all contribute to just one single positional-error function—i.e. a continuous function that defines the positional error along the rod. That function itself varies with position along the rod, but as explained in this document can advantageously be accounted for by a single offset in certain circumstances.)

In the case of storing such a substantially single offset value, one preference is that this value equal in magnitude (in ways detailed later) the effects upon dot-placement error of a median departure of the rod from straightness, along substantially the entire length of the rod. An alternative preference here is that the value be equal in magnitude to the effects upon dot-placement error of an average of maximum and minimum departures of the rod from straightness, along substantially the entire length of the rod.

In this particular regard, yet another preference is that the value be approximately equal in magnitude to a weighted composite of the foregoing two choices—that is to say, a weighted composite of the effects upon dot-placement error due to: (1) a median departure, and (2) an average of maximum and minimum departures, of the rod from straightness.

Another basic preference is that the apparatus include plural offset values stored in the memory for use in compensating operation of the printhead within respective segments of the rod. In this case it is further desirable that the apparatus include some means for interpolating between the plural offset values. Still considering this same case, if plural printheads are present in the apparatus then it is preferable that each of the offset values be substantially an average of offsets of the plural printheads, as compared in position with the sensor.

Yet another basic preference is that a substantially continuous offset function (the continuous function mentioned four paragraphs above) be stored in the memory for use in compensating operation of the "at least one" printhead along substantially the entire length of the rod. In this case, if plural printheads are present it is further preferable that the offset function be substantially an average of offset functions for the plural printheads, as compared in position with the sensor.

Still another basic preference, with plural printheads in the system, is that the apparatus also include—for each pair of the plural printheads respectively—data stored in the memory for use in compensating operation of the respective printhead along substantially the entire length of the rod. In this case the data are selected from these two choices:

a respective separate, substantially continuous, offset function for each pair; and a respective offset value for each pair.

Another basic preference in the case of plural printheads is that the reading and applying means reduce undesired offset, due to the imperfection of straightness, between nominally aligned points printed with different ones of the plural printheads respectively. Another basic preference is that the memory include at least one of these choices:

an encoder for determining position and speed of the carriage—the encoder including a codestrip having indicia unequally spaced to compensate for the straightness imperfection;

an analog electronic or optical circuit formed or adjusted to compensate for the straightness imperfections;

a mechanical cam or linkage formed or adjusted to compensate for the straightness imperfections; and electronic storage of polynomial coefficients for approximating a function characterizing the straightness imperfections.

Another preference is that the reading and applying means include at least one of these choices, to compensate for the straightness imperfections:

means for modifying signals from an encoder that reports position or speed, or both, of the carriage along the rod;

means for controlling position or speed, or both, of the carriage along the rod;

means for controlling timing of actuation of said marking by the printhead;

means for controlling velocity of propagation of said marking from the printhead toward the medium;

means for adjusting position specifications in image data to compensate for the straightness imperfections;

means for adjusting positional relationships between color planes in image data, to compensate for the straightness imperfections; and means for modifying pixel structure of image data.

In preferred embodiments of a second of its aspects, the invention is a method of calibrating a scanning printer, which printer has plural printheads, and a printhead support-and-guide rod that is not perfectly straight, and which printer also has a memory for storing rod-straightness calibration data. The method includes the step of measuring straightness deviations in the printhead support-and-guide rod of the printer. (As will be understood an equivalent is measuring the effect of straightness deviations upon print errors.)

The method also includes the step of then, based upon the measured deviations, calculating expectable placement errors, along the printhead support-and-guide rod, between pairs of indicia printed with different printheads respectively. Another step is then, based upon the calculated expectable placement errors, determining the rod-straightness calibration data.

A further step is then storing the determined rod-straightness calibration data in the memory of the printer. The foregoing may constitute a description or definition of the second facet of the invention in its broadest or most general form.

Even in this general form, however, it can be seen that this aspect of the invention too significantly mitigates the difficulties left unresolved in the art. In particular, this second facet of the invention complements the first aspect discussed above, by providing the data assumed in the structure of the first aspect.

Although this second aspect of the invention in its broad form thus represents a significant advance in the art, it is preferably practiced in conjunction with certain other features or characteristics that further enhance enjoyment of overall benefits.

For example it is preferred that the measuring step include operating the plural printheads along the rod to print respective plural indicia in a series, and then moving a sensor along the rod to measure indicia relative positions. In this case the operating step preferably includes printing the indicia with two printheads in alternation—to provide an alternating series of indicia for the two printheads respectively. This step, if there are three or more printheads spaced along the rod, is ideally performed by printing the indicia with the two printheads that are furthest apart.

The preferred method of printing indicia in a series is particularly useful when performed in conjunction with a procedure for determining and compensating for inter-printhead alignment, over a limited fraction of the rod length. In this case, it is preferred that the method also include comparing (1) the range of placement errors within that limited fraction of the rod length with (2) the range of placement errors over substantially the entire rod length.

When that comparison is included in the overall rod-straightness calibration procedure, it is further preferred that the calibration-data determining step include introducing the difference between those two placement-error ranges into the interprinthead alignment. Still more preferably, the difference-introducing includes distributing the introduced difference as between alignment values for neighboring printheads.

Also in the preferred method of printing indicia in a series, a preferable alternative procedure includes, in the operating step, printing nominally aligned thin indicia side-by-side with two printheads. In this case it is further preferable that the measuring step include optically measuring actual misalignment between the nominally aligned thin indicia.

An alternative basic preference, as to the second main aspect of the invention, is that the measuring step include using independent precision measuring instruments to measure the deviations. (Such instruments may, for instance, include standard quality-control test-bench equipment, either mechanical or optical—including interferometric devices; or may include special custom jigs and fixtures developed for this particular component.)

As between the two main alternatives of measuring the deviations by printing and reading a pattern, or by independent measuring instruments, the first is considered better. This is because it can be made very fast and completely automatic, and requires no additional hardware beyond a sensor that typically is already included (mounted on the printhead carriage) in the printer for interhead alignments.

In preferred embodiments of a third basic aspect or facet, the invention is apparatus for printing images on a printing medium, by construction from individual marks formed in pixel column-and-row arrays. The apparatus includes an input stage receiving or generating an image data array for use in printing, and at least one printhead for marking on the printing medium.

It also includes a carriage holding the printhead, a rod supporting the carriage for scanning motion across the printing medium, and a printing-medium advance mechanism for providing relative motion between the printhead and printing medium along a direction substantially orthogonal to the rod. In addition it includes a memory for storing rod-straightness calibration data.

Also included in the apparatus are some means for reading the rod-straightness calibration data from the memory—and for applying these data to modify the image data array, to compensate in operation of the printhead for imperfection in straightness of the rod. As will be understood by those skilled in this field, this facet of the invention is beneficial in operation of image-processing application programs that are readily amenable to modification of the image data, preparatory to printing.

Some such systems are, for example, vector graphics programs—in which bitmap equivalencies are determined as a printing make-ready step, and the computations are simply modified to allow for rod-straightness deviations in the printer. Bitmap graphics, however, can also be handled in an analogous way by incorporating a nonlinearity into the pixel grid structure.

Thus modification of position-encoder signals is far from the only way to effectively apply calibration data. Other practical points for insertion of the correction have been mentioned above.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

1. Basic Hardware for Implementation of the Invention

Figure 6:
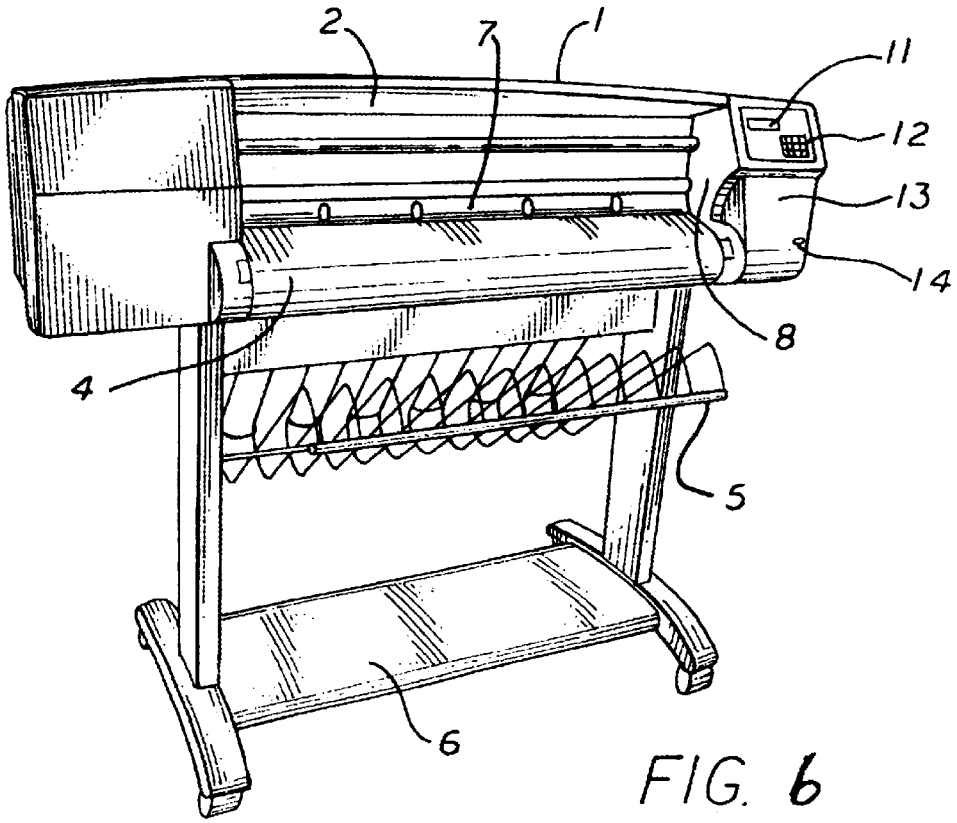
FIG. 6 is an isometric or perspective exterior view of a large-format printer-plotter which is a preferred embodiment of the present invention, and which corresponds to the conceptual presentations of FIGS. 1 through 5.

This discussion offers a more mechanical understanding of the apparatus represented by the very schematic diagrams discussed above. The preferred printer/plotter includes a main case 1 (FIG. 6) with a window 2, and a left-hand pod 3 that encloses one end of the chassis. Within that pod are carriage-support and -drive mechanics and one end of the printing-medium advance mechanism, as well as a pen-refill station containing supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included are a lever 8 for control of the gripping of the print medium by the machine.

A front-panel display 11 and controls 12 are mounted in the skin of the right-hand pod 13. That pod encloses the right end of the carriage mechanics and of the medium advance mechanism, and also a printhead cleaning station. Near the bottom of the right-hand pod for readiest access is a standby switch 14.

Figure 7:
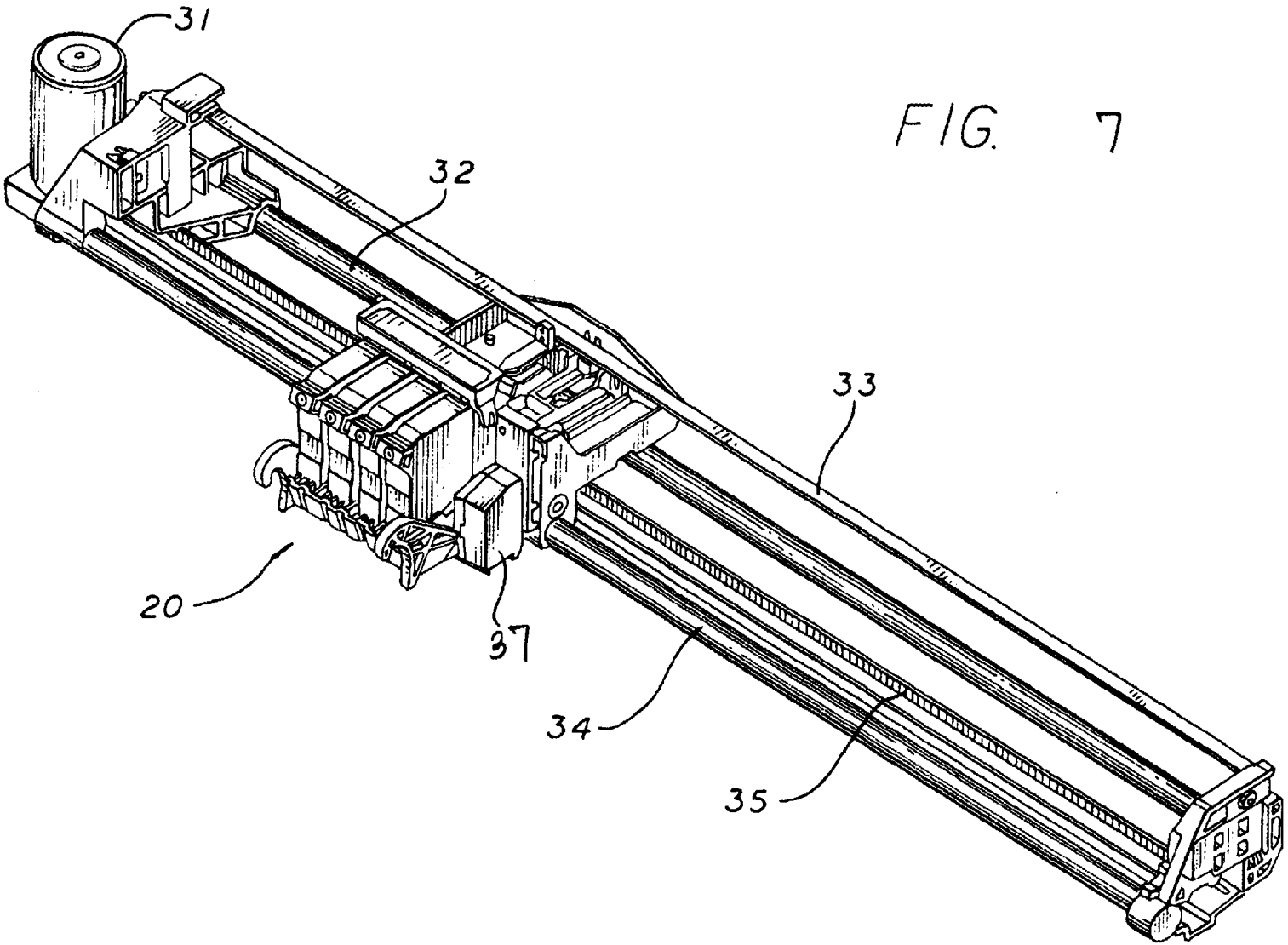
FIG. 7 is a like view, but of a carriage and carriage-drive mechanism which is mounted within the case or cover of the FIG. 6 device.

Within the case 1 and pods 3, 13 the carriage assembly 20 (FIG. 7) is driven in reciprocation by a motor 31—along dual support and guide rails 32, 34—through the intermediary of a drive belt 35. The motor 31 is under the control of signals 57 from a digital electronic microprocessor (essentially all of FIG. 19 except the print engine 50). In a block diagrammatic showing, the carriage assembly 20 travels to the right 55 and left (not shown) while discharging ink 54.

A very finely graduated encoder strip 33 is extended taut along the scanning path of the carriage assembly 20, and read by an automatic optoelectronic sensor 133, 233 to provide position and speed information 52 for the microprocessor. (In FIG. 19, signals in the print engine are flowing from left to right except the information 52 fed back from the encoder sensor 233—as indicated by the associated leftward arrow—and the test-pattern data 58 discussed below.)

The codestrip 33 thus enables formation of color inkdrops at ultrahigh resolution (as mentioned earlier, typically 24 pixels/mm) and precision, during scanning of the carriage assembly 20 in each direction.

Figure 3:
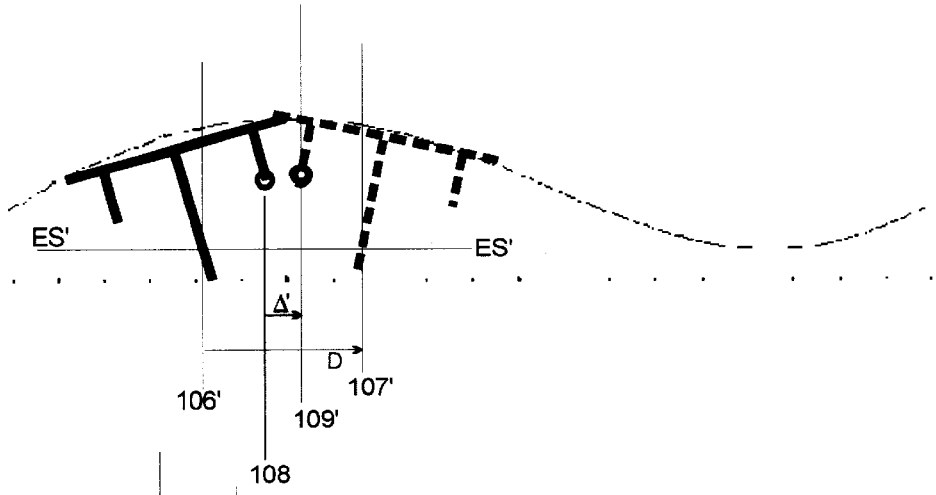
FIG. 3 is a like diagram but with the encoder strip in a different location relative to the other components.
Figure 4:
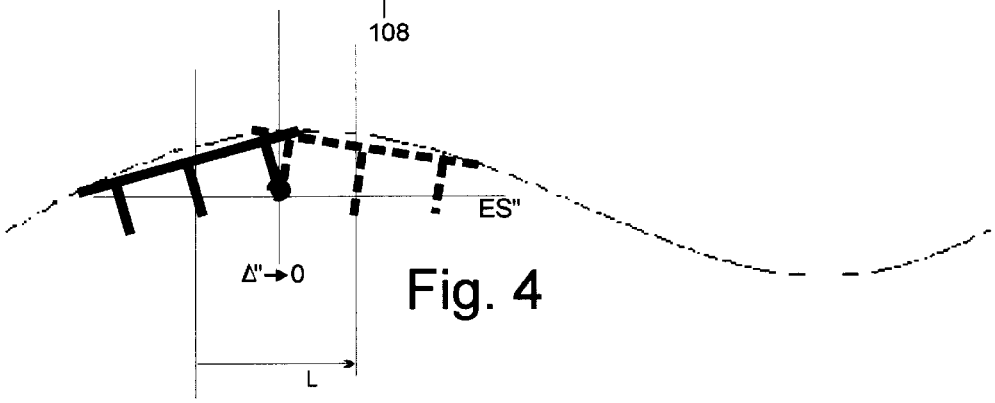
FIG. 4 is a like diagram but theoretical, and with the encoder strip in yet another location.

A currently preferred location for the encoder strip 33 is near the rear of the carriage tray (remote from the space into which a user's hands are inserted for servicing of the pen refill cartridges). Immediately behind the pens is another advantageous position for the strip 36 (FIG. 3). The encoder sensor 133 (for use with the encoder strip in its forward position 33) or 233 (for rearward position 36) is disposed with its optical beam passing through orifices or transparent portions of a scale formed in the strip.

Figure 8:
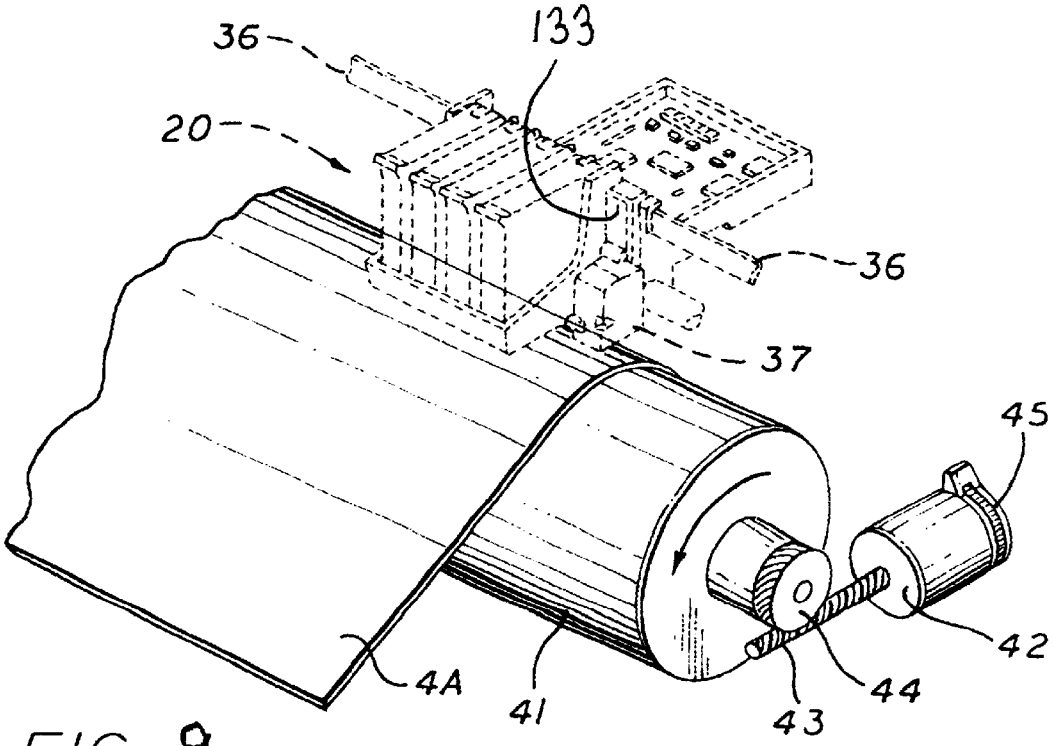
FIG. 8 is a like view of a printing-medium advance mechanism which is also mounted within the case or cover of the FIG. 6 device, in association with the carriage as indicated in the broken line in FIG. 8.

A cylindrical platen 41 (FIG. 8)—driven by a motor 42, worm 43 and worm gear 44 under control of signals 46 from the processor 15—rotates under the carriage-assembly 20 scan track to drive sheets or lengths of printing medium 4A in a medium-advance direction perpendicular to the scanning. Print medium 4A is thereby drawn out of the print-medium roll cover 4, passed under the pens on the carriage 20 to receive inkdrops 54 for formation of a desired image, and ejected into the print-medium bin 5.

Figure 9:
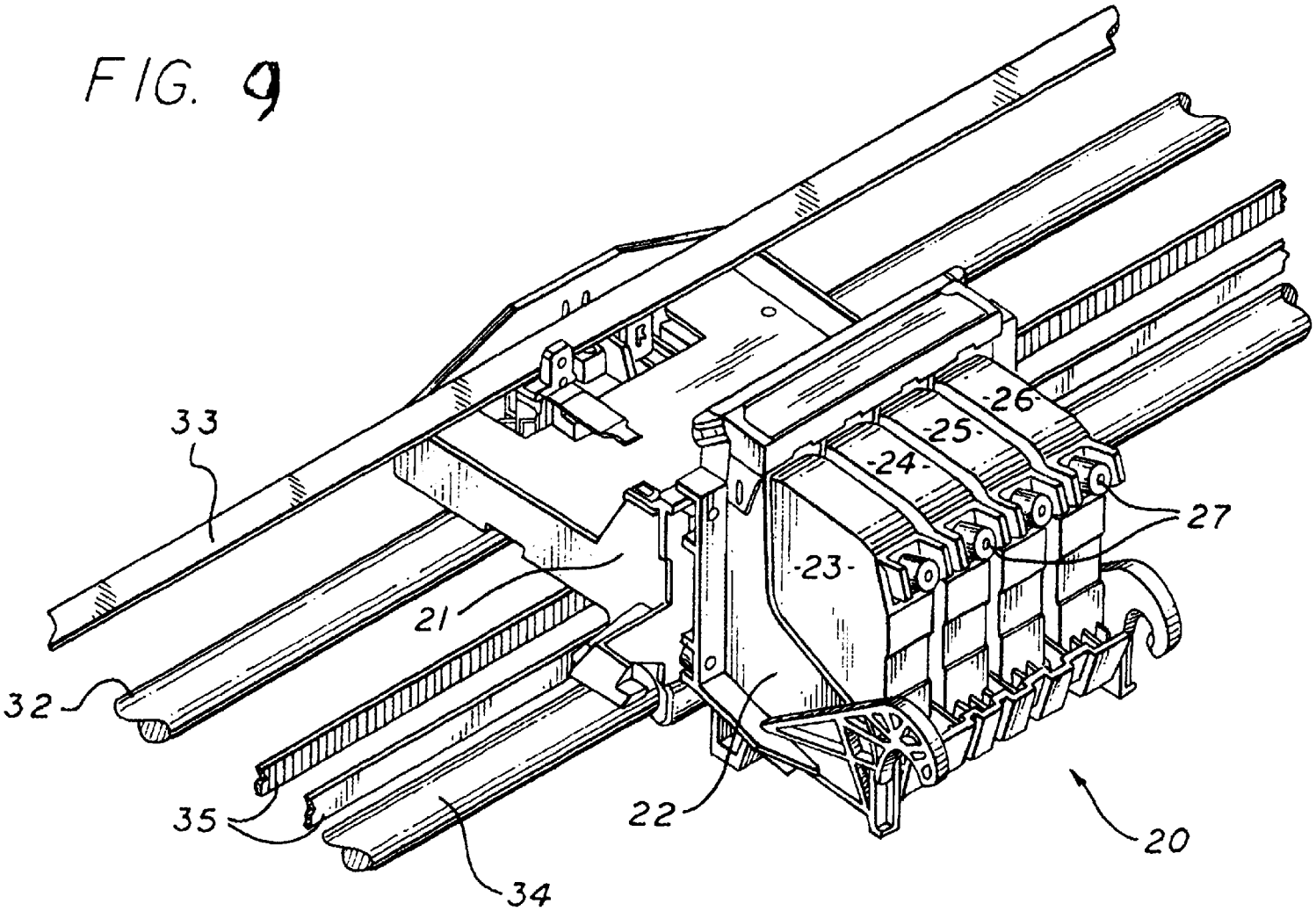
FIG. 9 is a like but more-detailed view of the FIG. 7 carriage, showing the printheads or pens which it carries.

The carriage assembly 20 includes a previously mentioned rear tray 21 (FIG. 9) carrying various electronics. It also includes bays 22 for preferably four pens 23–26 holding ink of four different colors respectively—preferably cyan in the leftmost pen 23, then magenta 24, yellow 25 and black 26.

Figure 10:
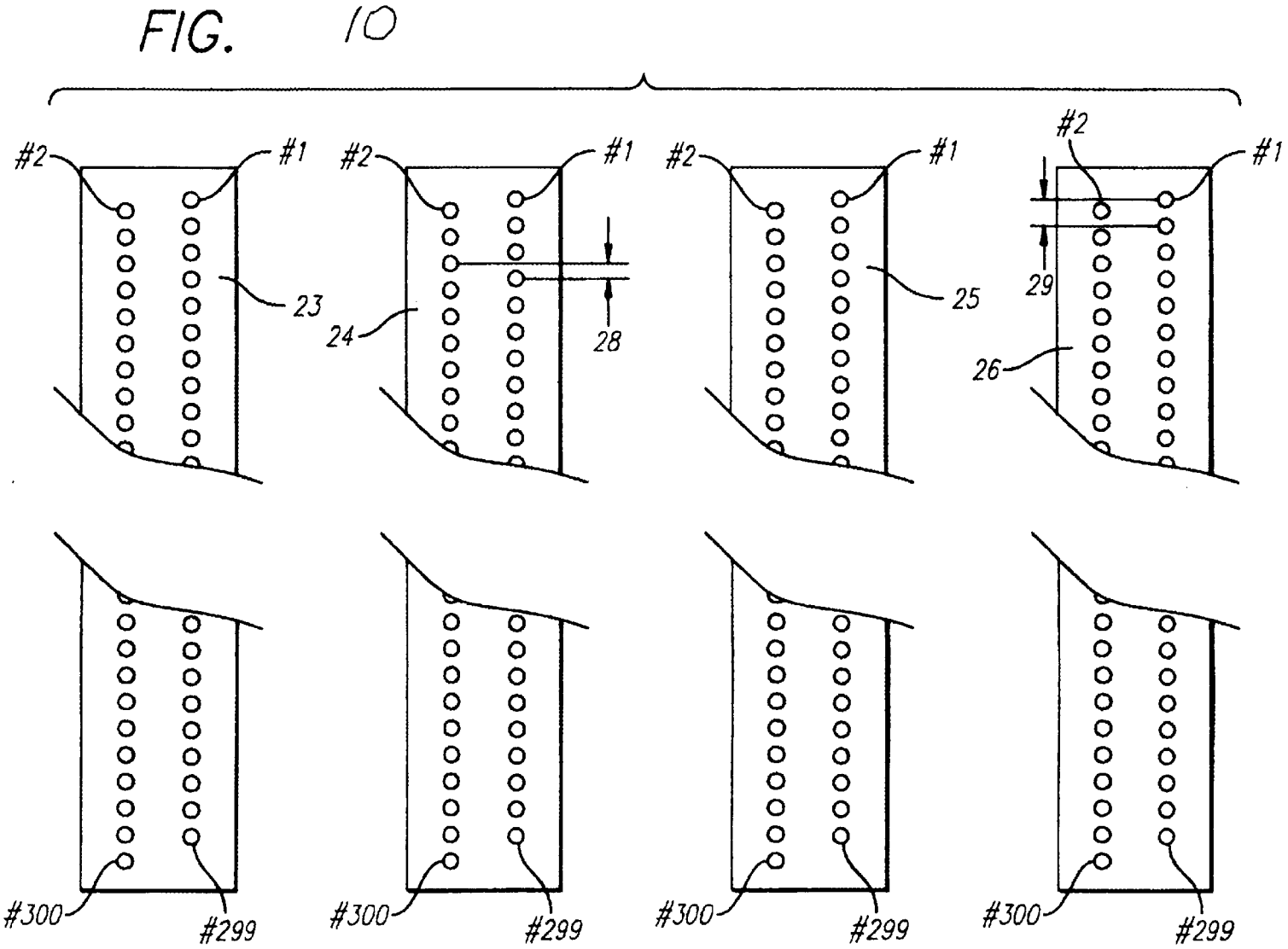
FIG. 10 is a bottom plan of the printheads or pens, showing their nozzle arrays.

Each of these pens, particularly in a large-format printer/plotter as shown, preferably includes a respective ink-refill valve 27. The pens, unlike those in earlier mixed-resolution printer systems, all are relatively long and all have nozzle spacing 29 (FIG. 10) equal to one-twelfth millimeter—along each of two parallel columns of nozzles. These two columns contain respectively the odd-numbered nozzles 1 to 299, and even-numbered nozzles 2 to 300, for the product model shown in FIGS. 6 through 10; the numbers are 1 to 523 and 262 to 524, in a later model.

The two columns, thus having a total of one hundred fifty nozzles each, are offset vertically by half the nozzle spacing, so that the effective pitch of each two-column nozzle array is approximately one-twenty-fourth millimeter. The natural resolution of the nozzle array in each pen is thereby made approximately twenty-four nozzles (yielding twenty-four pixels) per millimeter, or 600 per inch.

Preferably black (or other monochrome) and color are treated identically as to speed and most other parameters. In the preferred embodiment the number of printhead nozzles used is always two hundred forty, out of the three hundred nozzles (FIG. 10) in the pens—and again for the later model the numbers are five hundred twelve and five hundred twenty-four.

This arrangement allows for software/firmware adjustment of the effective firing height of the pen over a range of ±30 nozzles (±6 in the later model), at approximately 24 nozzles/mm, or ±30/24 =±1¼ mm (±¼ mm in the later unit). This adjustment is achieved without any mechanical motion of the pen along the print-medium advance direction.

An important characteristic of the mechanism, for purposes of the present invention, is that alignment of the pens can be automatically checked and corrected through use of the extra nozzles. As will be understood, the invention is amenable to use with a very great variety in the number of nozzles actually operated.

Figure 1:
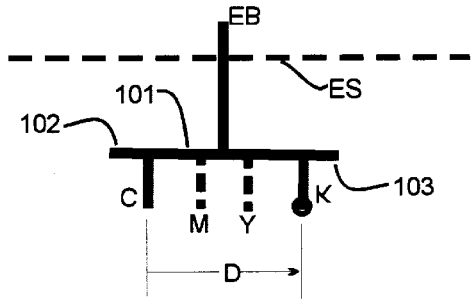
FIG. 1 is a very highly schematic diagram in plan, representing in an abstract or conceptual way a printer carriage with printheads and sensor—and also in relation to a printer encoder strip—particularly for orientation to use of like representations in the three following figures as discussed above.
Figure 2:
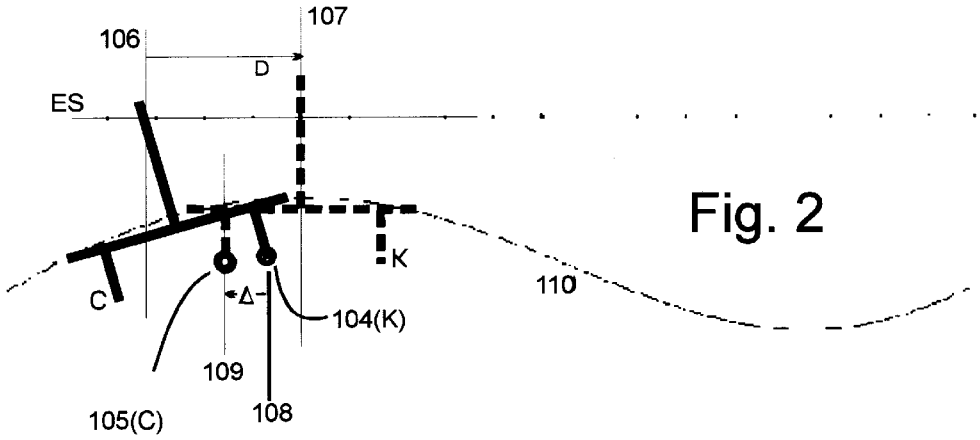
FIG. 2 is a diagram in plan, showing the same printer carriage, printheads and sensor in two positions (one in the solid line and the other in the dashed line) relative to a carriage support/guide rod and the encoder strip, and with curvature of the rod grossly exaggerated for clarity of presentation of the recognitions underlying the present invention.
Figure 23:
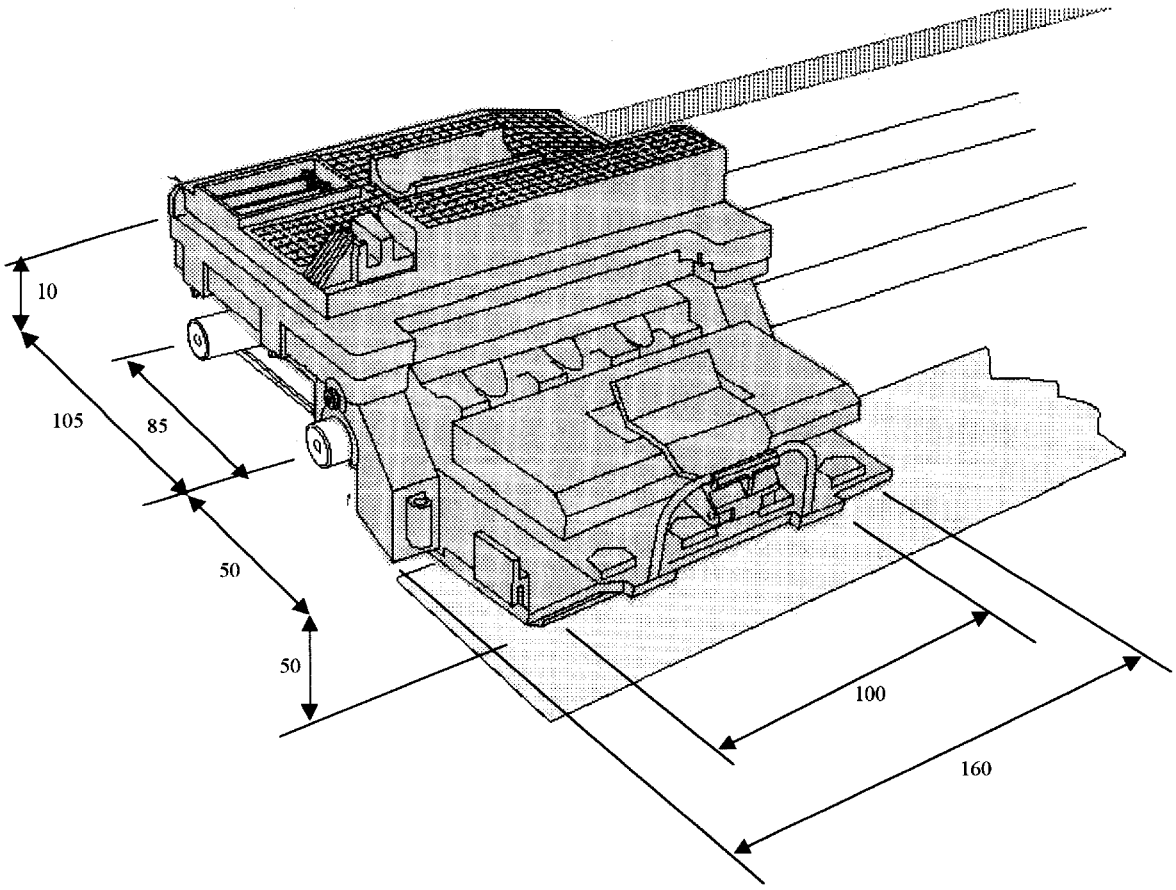
FIG. 23 is an isometric view showing some dimensions, in millimeters, of the carriage and chassis.

Nominal distance of the center of the nozzle array (i.e., nozzles #150, #151—or in the later model 262 and 263) from the rod axis is 50 mm in plan. In FIG. 1 this distance is represented by the lengths of the lines C, M, Y and K. Nominal distance of the sensor strip ES from the rod axis 102–103 is 105 mm in plan. Element D in FIG. 1 corresponds to 100 in FIG. 23.

Figure 5:
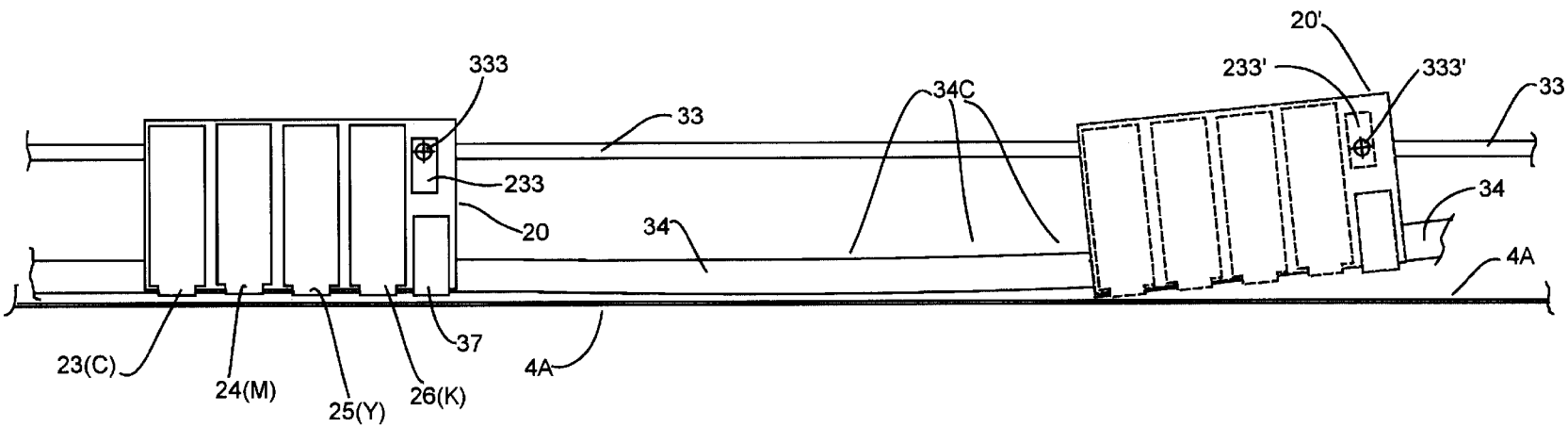
FIG. 5 is an elevational view of the carriage, showing height relationships among the encoder, printheads and support/guide rod—this view being somewhat less schematic than the plan views of FIGS. 1 through 3, but again with the carriage in two positions along a rod whose illustrated curvature is grossly exaggerated.

The nominal distance of the center of the nozzle array from the rod axis is 50 mm in elevation. In FIG. 5 this is the distance from the bottoms of the pen bodies 23 (C)–26 (K) to the centerline of the rod 34.

The nominal distance of the sensor strip from the rod axis is 10 mm in elevation. In FIG. 5 this is the distance from the sensor/strip measurement target points 333, 333' to the rod centerline.

These dimensions interact with imperfections in rod straightness to cause the dot-placement errors of interest in this document. Other dimensions related to the carriage appear in FIG. 23.

Errors due to vertical deviations of the rod from straightness have been found to account for very roughly a third of total deviations. Initially, straightness of the rod is better than that of its base or beam.

Some errors in the beam, however, are transferred to the rod—leading to further degradation in the rod. Variation in interpen errors, and in pen vs. encoder errors, as a function of carriage position along the scan axis is discussed below.

2. Data Relationships a. Placement errors between adjacent heads—Due to the printhead order in the carriage—black, yellow, magenta and cyan (KYMC in advance)—the physical distance between the black and cyan printheads (in the y axis) is three times the distance between neighbor colors. Neighbor pen-to-pen printed errors (K-Y, Y-M and M-C) are always smaller than the K-C error, and their addition results in the K-C error. The proportion between the pen-to-pen physical distance in the carriage and the K-C physical distance also applies to their relative dot-placement errors, so for example, the K-Y error along the scan axis is approximately one third of the K-C error.

In the measuring of pen-to-pen errors, determined errors on the paper do not correspond to identical encoder positions. For example, the measured Y-K distance in a certain area is printed with the carriage in a different position than the M-C and Y-M patterns in the same area (the common reference is the paper). As a result, although neighboring color-error curves are almost identical they have a relative phase equal to the difference between the pen positions in the carriage.

Even though, being neighbor pens, the Y-K, M-C and Y-M errors are equal to one-third of the K-C error, it is not correct to suppose that they are proportional to the same K-C error. The reason for this is that curvature changes along the swath are first manifested by the K-Y errors as the leading edge of the carriage reaches a zone of particular curvature, whereas C-M exhibits the effect later when the rear bushing of the carriage reaches that particular curved zone. Nevertheless, as will be seen later, in some products—due to particular characteristics of the alignment pattern—one-third of the K-C error is a good approximation for color-to-color errors.

b. Corrective strategies—One way to resolve the problem of these errors is by keeping tight mechanical straightness specifications, but doing so would be relatively expensive. Alternative mechanical solutions include placing the encoder sensor closer to the printhead nozzles so that any positioning inaccuracy experienced by the printhead would be more accurately reflected in the encoder reading—but as noted above this would aggravate operator interaction with the codestrip.

In the absence of an active solution, the result would be a constant difficult trade-off between print quality, on the one hand, and yield due to scrapping of defective chassis on the other hand. No previous solution is known to the present inventors.

The present invention instead follows a calibration strategy. The procedure aims to adjust the apparatus so that the errors are not perceivable with the unaided eye.

c. Preferred application of error measurements—As will be seen, the most highly preferred straightness-calibration approach—but by no means the only one—is to equilibrate the error range centered roughly on zero. It is preferable to do so by modifying the separately performed interpen alignments, which have now become conventional. The preferred automatic calibration chooses the proper offset to apply to the pen-to-pen error curve, to achieve this zero-centered goal so that the errors remaining are as close to zero as possible.

In our products the interpen alignments are determined based upon measurements in a test-pattern zone (the plateau shown in the stepped heavy straight line in FIG. 11) which is located approximately at the center of the printer imaging region. That zone is centered on two screws that tighten the rod to another part of the chassis, namely the rod beam or base.

In this zone, the conventional independent interpen-alignment algorithm calculates and corrects the measured distances between colors—i.e., between printheads. Those corrections are stored in memory for future operation of the printer, as long as all the same heads are in place.

The present invention preferably operates to provide a straightness calibration as a single-value perturbation of that conventional interpen alignment. The result is to minimize droplet placement errors occurring across the printer swath. This provides increased tolerance for error in both print quality and manufacturing yield (the chassis being an expensive part in the product), without the need for the significant trade-offs mentioned earlier.

An advantage of this correction is that it depends only on systematic defects (i.e., those arising from permanent deformations of the printer chassis), with no dependency on the media or the printheads. Therefore, advantageously, the preferred calibration need take place only once—in the production line—and the results can be stored in the printer's nonvolatile memory then.

Figure 11:
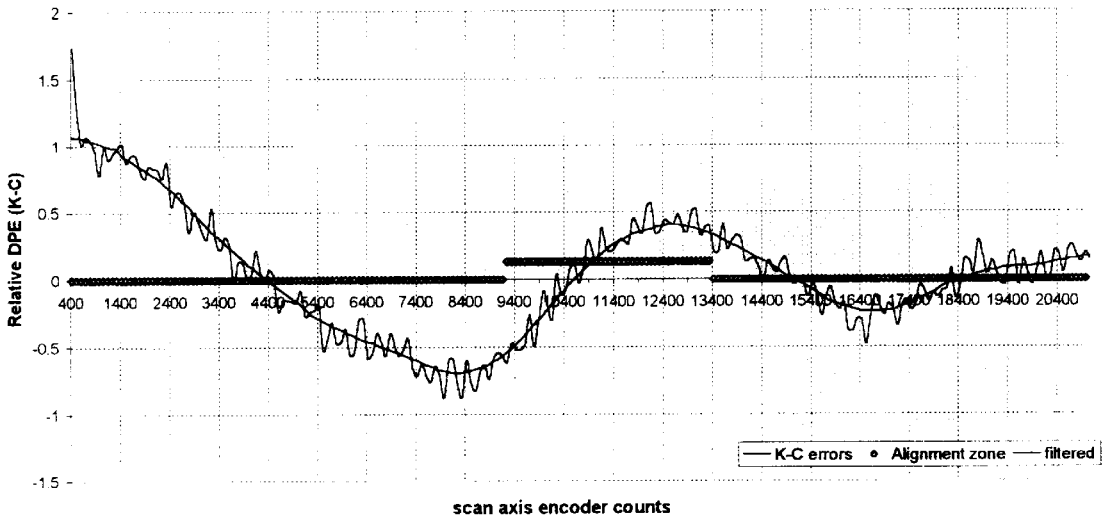
FIG. 11 is a graph of relative dot-placement error (DPE), measured in units of pixel columns, for two printheads (cyan and black) that are outboard or furthest apart on the carriage, as a function of scan-axis position (measured in units of counts of the carriage encoder 233), in a representative printer/plotter.

In the particular printer unit which was used to collect the data seen in FIG. 11, the errors in the interpen alignment zone happen to be located near the error-range centerpoint—i.e., in a quite central region of the error values along the ordinate axis. The maximum and minimum errors, particularly as compared with those in the alignment zone, are of similar magnitude.

Figure 15:
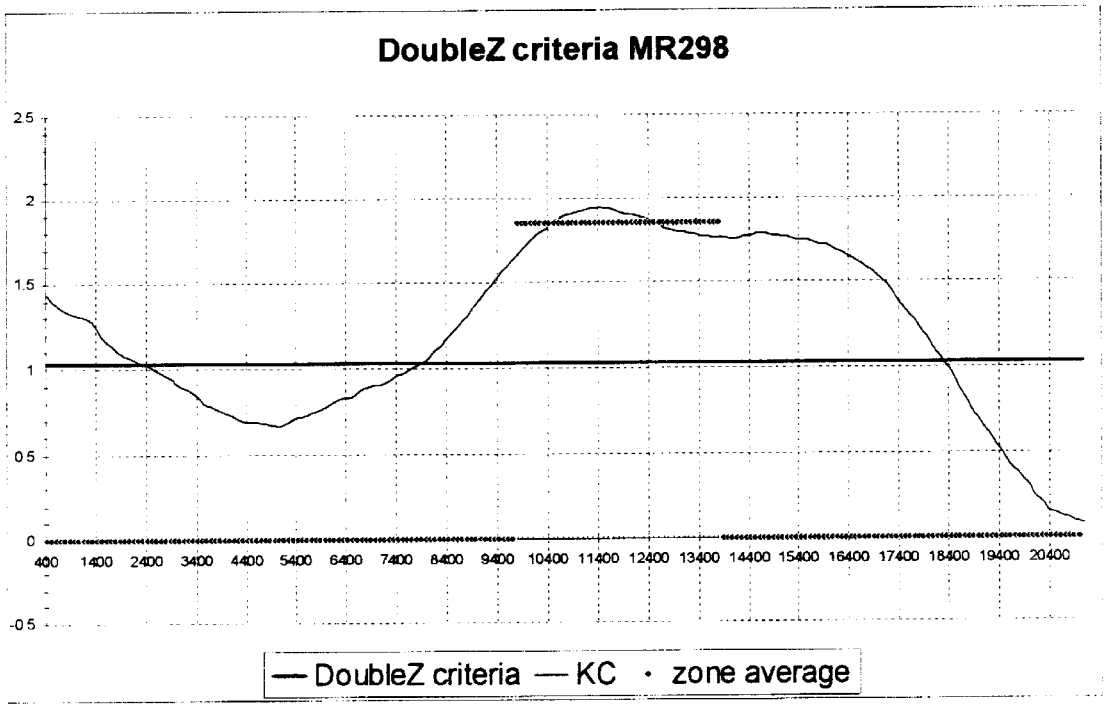
FIG. 15 is a graph comparing "Double-Z" criteria (explained below) with a zone average for the outboard printhead pair.

This means that without any further calibration, the remaining errors along the scan axis are only reaching the error specifications (one pixel column) at the left end of the swath. Thus the present invention would not have been needed in that particular production unit (FIG. 11; this may be contrasted with the example of FIG. 15).

d. Statistics for shifting interpen alignment—The invention minimizes systematic errors along the scan-axis direction, mostly originating from Theta-X and Theta-Z variations. It is now implemented in one product and can be applied to virtually any future product.

The invention measures relative K-C errors along the scan axis—preferably using the printer line sensor. These errors can also be measured with other tools such as for example three-dimensional measurement machines or other mechanical tools.

Once the errors along the scan axis are known, the calibration procedure considers both the median (denoted M) of the errors, and the centerpoint (denoted P) of the error range (denoted R). The centerpoint is the average of the maximum and minimum errors.

The median error M is in a sense the preferred statistic for the measured errors, since it takes into account how the mass of the error data lies. If used alone, however, the median would make the calibration undesirably vulnerable to domination by error measurements that predominate, to the total exclusion of outliers—that is to say, extreme error values.

This is undesirable because an objective is to bring the apparatus into performance specifications throughout the operating span of the carriage. The error-range centerpoint P, on the other hand, while responding to outliers (because it is defined in terms of the extrema) gives just as much importance to one extreme error value as it does to dozens of more-central error values.

The preferred calibration procedure makes a choice that is a nonlinear combination of the two statistics M and P. The combination is calculated using two opposite weighting functions, which depend on the error range R.

The weighting function for the M statistic decreases with the range R, whereas that for the P statistic increases with the range. This criterion provides a good balance between the two statistics—protecting against skew of the entire calibration due merely to extremely sharp error peaks in very local areas of the swath, but at the same time avoiding more-broadly based perceptible errors.

e. Double-Z or K-C calibration—In devising a calibration, two main areas of uncertainty appear: first, how to provide a regimen that minimizes perceptible errors; and second, how best to measure the hardware deviations and properly calibrate the printer. As to the first of these main areas, for the present invention a goal has been adopted and assigned the nickname "Double-Z":

no point in the scan axis is to exceed the color-to-color alignment specification, and average color-to-color misalignment is to be minimized.

As to the second of the two main areas of uncertainty mentioned above, it is important that the procedures minimize the time required, be simple to perform, and yet be sufficiently robust as to require performance only once in the life of the product, namely on the assembly line.

In accordance with certain aspects of the present invention, it is preferred to measure only the K-C error, with an alternating-block technique described in section 5a below, and to treat every neighboring color pair proportionally as one-third of the total K-C error (in this document symbolized as "KC/3"). This latter choice was made only after painstaking study of the maximum possible error introduced by considering proportional parts instead of measuring each color explicitly.

In the study, both theoretical and an experimental approach were followed. Data taken with a representative printer show that one-third of the black-to-cyan error, KC/3 (FIG. 12), although quite similar to every color pair measurement, is far less noisy. Similar graphs were obtained from eleven other production-prototype or actual-production printer units.

It is also revealing to consider the differentials (FIG. 13) between those same error values. All differences between the KC/3 trace and measurements for every color pair are contained below 0.1 pixel columns. Average differences along the scan axis, particularly in the alignment zone, are collected in the tables below for a representative unit:

TABLE 1

Figure 12:
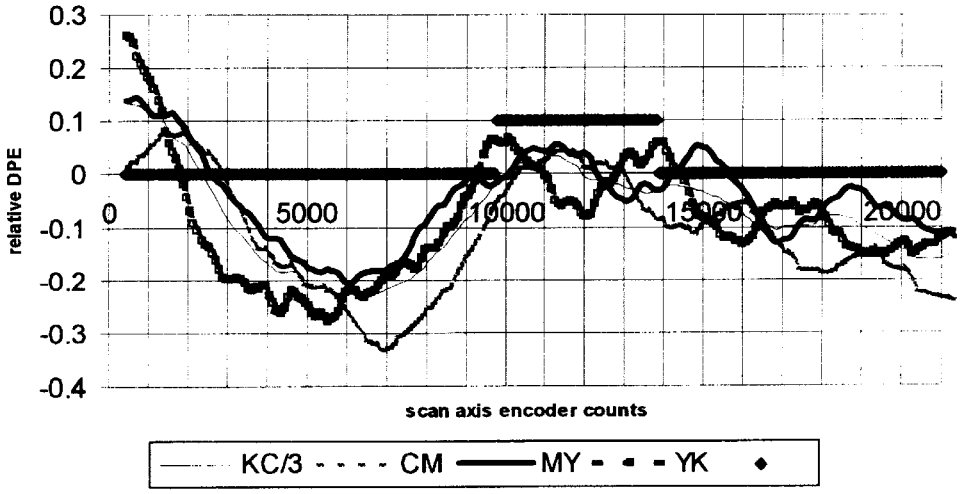
FIG. 12 is a like graph for three interhead pairs, and also showing for comparison one-third of the relative error graphed in FIG. 11.
Figure 13:
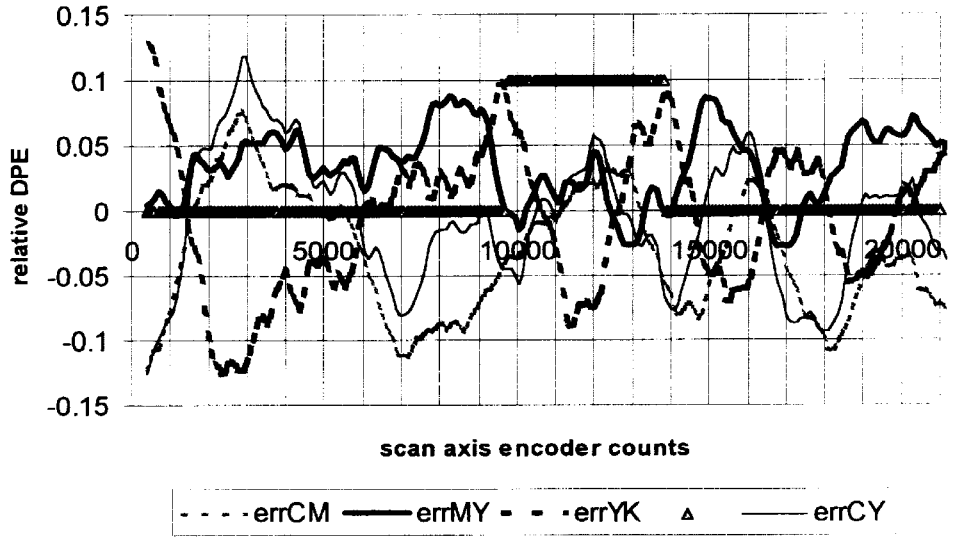
FIG. 13 is a like graph for certain interhead errors corrected by a weighted single-offset adjustment.

Errors (in pixel columns) for the printer shown in FIGS. 12 and 13

| error value | average errors, pair-to-pair, minus KC/3: over full operating span | average errors, pair-to-pair, minus KC/3: within alignment area only |
|---|---|---|
| C-M | 0.055914 | 0.031385 |
| M-Y | 0.037434 | 0.02155 |
| Y-K | 0.060689 | 0.035378 |
| C-Y | 0.063305 | 0.033596 |

TABLE 2

Estimated errors (in pixel columns) for product line, based on measured printers

| average error | value |
|---|---|
| overall | 0.042406 |
| overall plus 3 sigma | 0.091916 |

Using a theoretical approach, the worst-case printer would have a total error range of two pixel columns, which corresponds to the maximum K-C error here assumed to be allowed by chassis specifications. If this printer had a maximum curvature change just in the alignment zone, the phase between color pairs would maximize the difference between (1) measuring only K-C error and dividing by three, and (2) measuring color-to-color directly.

With these two premises the largest expectable error is 0.25 pixel column, for C-Y (the worst-case color pair). Therefore, even the largest possible error is acceptable since the specification for color-to-color alignment is taken as one pixel column, which wouldn't in any case be surpassed.

f. How the Double-Z correction is calculated—Once the K-C error curve has been measured, and the relationship between the overall error range and the range within the interpen alignment zone has been taken into account, it can be determined whether to introduce some offset in the pen-to-pen alignment values. Without the Double-Z correction, the interpen alignment algorithm—which operates wholly independently of the present invention—simply calculates the pen-to-pen offsets based upon its own measurements in the alignment zone, as a local average of the curve. If the curve has a maximum or a minimum in that zone, the pen-alignment area will be within specifications, but other zones in the scan axis can have pen-to-pen errors up to two pixel columns.

As noted earlier, offsets are to be introduced to achieve the dual "Double-Z" goals: no point in the scan axis is to exceed the color-to-color alignment specification for the product, and the average color-to-color misalignment is to be minimized. With these two premises the following calibration method can be defined:

i) Measure K-C error along the scan axis (preferably using the alternating-block method described below).

ii) Filter the data with a moving average (see figures below).

iii) Calculate the local average of the curve in the interpen alignment zone.

iv) Calculate the desired pen-to-pen alignment value that satisfies the Double-Z criteria.

v) Calculate the distance (offset) between that value and the alignment local average.

vi) Introduce this offset proportionally in the pen-to-pen alignment values

M-C error=$\frac{1}{3}\cdot$(K-C error),

M-Y error=$\frac{1}{3}\cdot$(K-C error),

K-M error=$\frac{2}{3}\cdot$(K-C error).

vii) Store the values in EEROM.

viii) Always when a new conventional interpen alignment is performed, add or subtract the stored straightness-calibration offset values to the pen-to-pen measurements before storing the new interpen-alignment values.

g. The Double-Z criteria—The dual criteria stated earlier are translated into mathematical relations by calculating, for the K-C measured and filtered data, the:

median error M, error-range centerpoint P:

½(max. error+min. error), error range R:

(max. error−min. error), and local average error $A_{AZ\text{-}loc.}$ within only the alignment zone ("AZ").

Calculating the desired value for K-C alignment that minimizes the overall average error (i.e., over the whole carriage operating span) and that satisfies the single-pixel-column specification is achieved by balancing the median M and centerpoint P criteria with a weighting function that in turn depends on the range R.

When the range is high (more than 1.5 pixel column), more weight is given to the centerpoint criterion because otherwise some areas along the scan axis could be out of specifications. When the range is low (around 1.25 pixel column or less), the median criterion is weighted more—to look for a central calibration value, optimizing the calibration for the majority of the scan axis.

The shape of the curve is also weighted: if a maximum or a minimum is just a sharp peak, there will be a large discrepancy between the median and centerpoint criteria. The chosen value is therefore chosen to lie between the two. If the maximum or the minimum has a significant area below/above it, the median and centerpoint criteria tend to be more coincidental.

Figure 14:
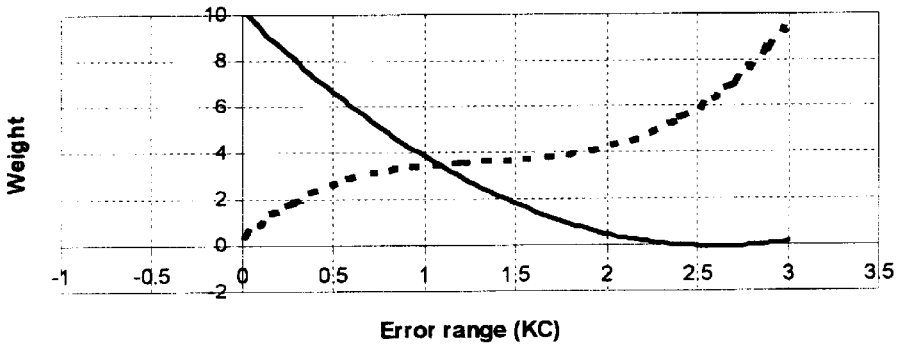
FIG. 14 is a graph showing two weight functions, for use in combining range-based (in the solid line) and median-based (in the dashed line) adjustments, as a function of observed error range.

Weighting functions are defined as $W_m$ (solid curve in FIG. 14) for the median and $W_p$ (dashed curve) for the centerpoint, thus:

$$W_m=1.5R^2-7.85R+10.2$$

$$W_p=1.15R^3-4.62R^2+6.5R+0.45$$

Adjustment of the weight functions was obtained after analyzing many real K-C error curves and many curves created artificially with a simulator.

Next the desired value for the pen-to-pen alignment (Double-Z criteria) is calculated as:

$$Double\text{-}Z=\frac{W_m}{W_m+W_p}M_e+\frac{W_p}{W_m+W_p}P=\frac{W_mM_e+W_pP}{W_m+W_p}$$

and the differential or offset Double-$Z_{diff.}$, to apply to the interpen K-C error—found independently by the interpen alignment procedure, but now identifiable as the local average error $A_{AZ\text{-}loc.}$ in the alignment zone ("AZ") only—is:

$$Double\text{-}Z_{diff.}=\frac{W_mM_e+W_pP}{W_m+W_p}-A_{AZ-loc.}$$

In applying this straightness-calibration adjustment (FIG. 14) to a K-C error curve for an actual printer, the local average $A_{AZ\text{-}loc.}$ is placed where the K-C errors are maximum. In other words, the pen alignment performs a local average of the color-to-color errors, with the pen-alignment area located approximately in the middle of the printer; if there is a maximum straightness error there, which delivers maximum (in absolute value) dot-placement errors, the K-C errors are consequently maximum there. The pen-alignment procedure, however, is blind to this fact—and in essence normalizes the overall operation to that zone anyway.

Due to these relationships, other areas of the scan axis could have large color-to-color alignment errors even if the rod is perfectly straight in those areas. Graphically the desired pen-to-pen alignment value (Double-Z) appears as a horizontal line extending entirely across the plot.

The Double-Z criteria are independent of the conventional interpen-alignment accuracy at the moment of straightness calibration. This means that it doesn't matter whether the separate interpen alignment for a printer has already been performed or not, when calibrating, because the separately, conventionally determined interpen offset is—in effect—calculated relative to the curve itself, not to any absolute reference.

3. Calibration Arrangements a. Self calibration: alternating-block test pattern—According to this method (which is the most highly preferred method), two adjacent series 201, 202 of small color blocks (FIG. 16) are printed all along the scan axis. Each series consists of alternating black blocks 203 and cyan blocks 204.

The block-to-block periodicity 206 is approximately 3.9 mm along the scan axis, i.e. in the y dimension. For some purposes it is more logical to consider the periodicity from black block to black block, which in practice turns out to be somewhat different; those skilled in the field will understand that this additional complication need not be considered here. In that same direction the spacing 205 between adjacent blocks is roughly 2.4 mm, and each block roughly 1½ mm long. Each block is 2½ mm wide (in the x dimension).

Then the line sensor of the machine is used to measure the dot-placement errors in these patterns, yielding two hundred thirty-two reference points. Measuring relative distances between the alternate color blocks, the system develops a profile of Theta-Y and Theta-Z dot-placement errors as discussed and graphed in the preceding section of this document. The resulting data (and graphical record if desired) of dot-placement errors for the K-C pen pair are then straightforwardly analyzed to provide the Double-Z calibration as already described.

b. Self calibration: split-bar test pattern—The errors can also be measured after printing a plot made of a number of thin vertical lines 207, 208 (FIG. 17) arrayed horizontally along the scan axis. The top half 207 of each line is black, and the bottom half 208 cyan.

With this plot, misalignments of the two colors can be measured optically—either visually, using a loupe, or by assigning this task to the line sensor in the printer as in the alternating-block method. Because the lines are much finer, however, the automatic-scan method in this case preferably operates rather slowly and the whole process is therefore more time consuming.

c. Calibration with independent instruments—Two other methods of characterizing a printer have been developed. These methods are purely mechanical.

One consists of taking specified measurements of the rod-beam assembly (chassis), and from these measurements calculating predicted placement errors. Such measurements are made in a conventional quality-control inspection device called a "coordinate measurement machine" (CMM) or more casually "the 3D machine".

Of interest are the parts of the chassis that contribute to its functional straightness, or deviations from straightness. Generally speaking, this process measures the rods themselves—the main, front support/guide rod 34, and the rear, outrigger slider rod 32.

In this process, z and y coordinates of numerous sections #1, #2, . . . #N (FIG. 18) along the scan axis are obtained.

It is also possible to measure the rod "beam" 434, i.e. only the rod-supporting base without the rods, but such measurements are less well correlated with actual DPE results.

Figure 18:
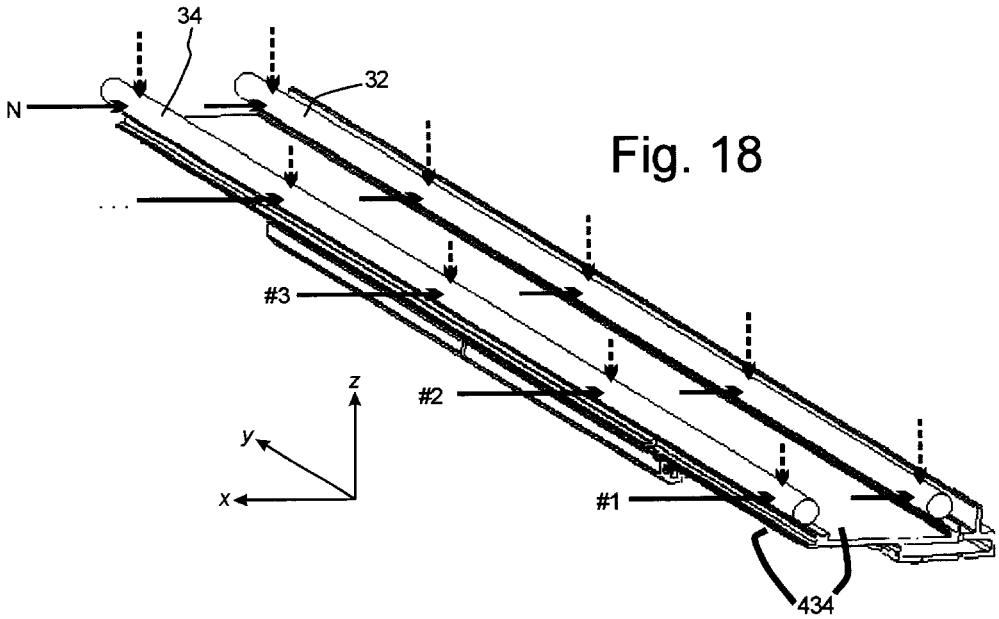
FIG. 18 is an isometric view representing a calibration strategy that relies upon independent precision measuring instrumentation.

The second method can be used on the production line and consists of operating a tool familiarly called "the piano". The piano, better adapted for high production volume than the 3D machine, includes a fixture for measuring and comparing z and y coordinates of different sections of the rod (assembled in the chassis). It has four feelers moving along the x-axis to measure the y and z errors of the two rods at the N points (FIG. 18).

With the data from either apparatus, a mathematical model is used to convert the error coordinates into expectable dot placement errors. This model prescribes geometric calculations based upon: distance from the front rod 34 to the encoder sensor, distance from that rod to the printheads 23–26 (FIG. 23), and measured coordinates of the front and rear rods 34, 32 in different sections (z and y for all three measurements).

The model then calculates predicted carriage rotation between consecutive sections of the rod. Given the rotation, the DPE effect is calculated straightforwardly using plane geometry—starting from the various nominal dimensions presented in subsection 1 of this DETAILED DESCRIPTION section.

For successful use of such a model, measurements are best taken at regular intervals along the x-axis. The intervals preferably are selected as a submultiple fraction of the distance between the carriage bushings (e.g., half or an eighth of the distance between the bushings).

Based on the geometry of the carriage, encoder and pens, the model yields a close estimate of dot-placement errors for the measured chassis, along the x-axis. This analysis is very well correlated with actual printing errors as measured on the printing medium.

d. Experimental prospects—A complete gauge R&R test has been performed. ("R&R" conventionally refers to tool repeatability at least three times finer than magnitude repeatability.) This test focused not only on measurement repeatability but the overall performance of the Double-Z calibration.

Estimations of measurement repeatability obtained through thirty measurements and ten alignments gave an overall repeatability of 0.044047 pixel columns. This result is logically similar to the results of the self-test methods outlined earlier.

4. Microprocessor Hardware a. Basic processing options—Data-processing arrangements for the present invention can take any of a great variety of forms. To begin with, image-processing and printing-control tasks 332, 40 can be shared (FIG. 19) among one or more processors in each of the printer 20 and an associated computer and/or raster image processor 30.

A raster image processor ("RIP") is nowadays often used to supplement or supplant the role of a computer or printer—or both—in the specialized and extremely processing-intensive work of preparing image data files for use, thereby releasing the printer and computer for other duties. Processors in a computer or RIP typically operate a program known as a "printer driver".

These several processors may or may not include general-purpose multitasking digital electronic microprocessors (usually found in the computer 30 ) which run software, or general-purpose dedicated processors (usually found in the printer 20 ) which run firmware, or application-specific integrated circuits (ASICs, also usually in the printer). As is well-understood nowadays, the specific distribution of the tasks of the present invention among all such devices, and still others not mentioned and perhaps not yet known, is primarily a matter of convenience and economics.

On the other hand, sharing is not required. If preferred the system may be designed and constructed for performance of all data processing in one or another of the FIG. 19 modules—in particular, for example, the printer 20.

Regardless of the distributive specifics, the overall system typically includes a memory 332*m* for holding color-corrected image data. These data may be developed in the computer or raster image processor, for example with specific artistic input by an operator, or may be received from an external source.

Ordinarily the input data proceed from image memory 232 to an image-processing stage 332 that includes some form of program memory 333—whether card memory or hard drive and RAM, or ROM or EPROM, or ASIC structures. The memory 232 provides instructions 334, 336 for automatic operation of rendition 335 and printmasking 337.

Image data cascades through these latter two stages 335, 337 in turn, resulting in new data 338 specifying the colorants to be deposited in each pixel, in each pass of the printhead carriage 20 over the printing medium 41. It remains for these data to be interpreted to form:

- actual printhead-actuating signals 53 (for causing precisely timed and precisely energized ink ejection or other colorant deposition 54),
- actual carriage-drive signals 57 (for operating a carriage-drive motor 35 that produces properly timed motion 55 of the printhead carriage across the printing medium), and
- actual print-medium-advance signals 46 (for energizing a medium-advance motor 42 that similarly produces suitably timed motion of the print-medium platen 43 and thereby the medium 41).

Such interpretation is performed in the printing control module 40. In addition the printing control module 40 may typically be assigned the tasks of receiving and interpreting the encoder signal 52 fed back from the encoder sensor 233, and in some cases also the line-sensor signal 58 fed back from that sensor 37.

Figure 19:
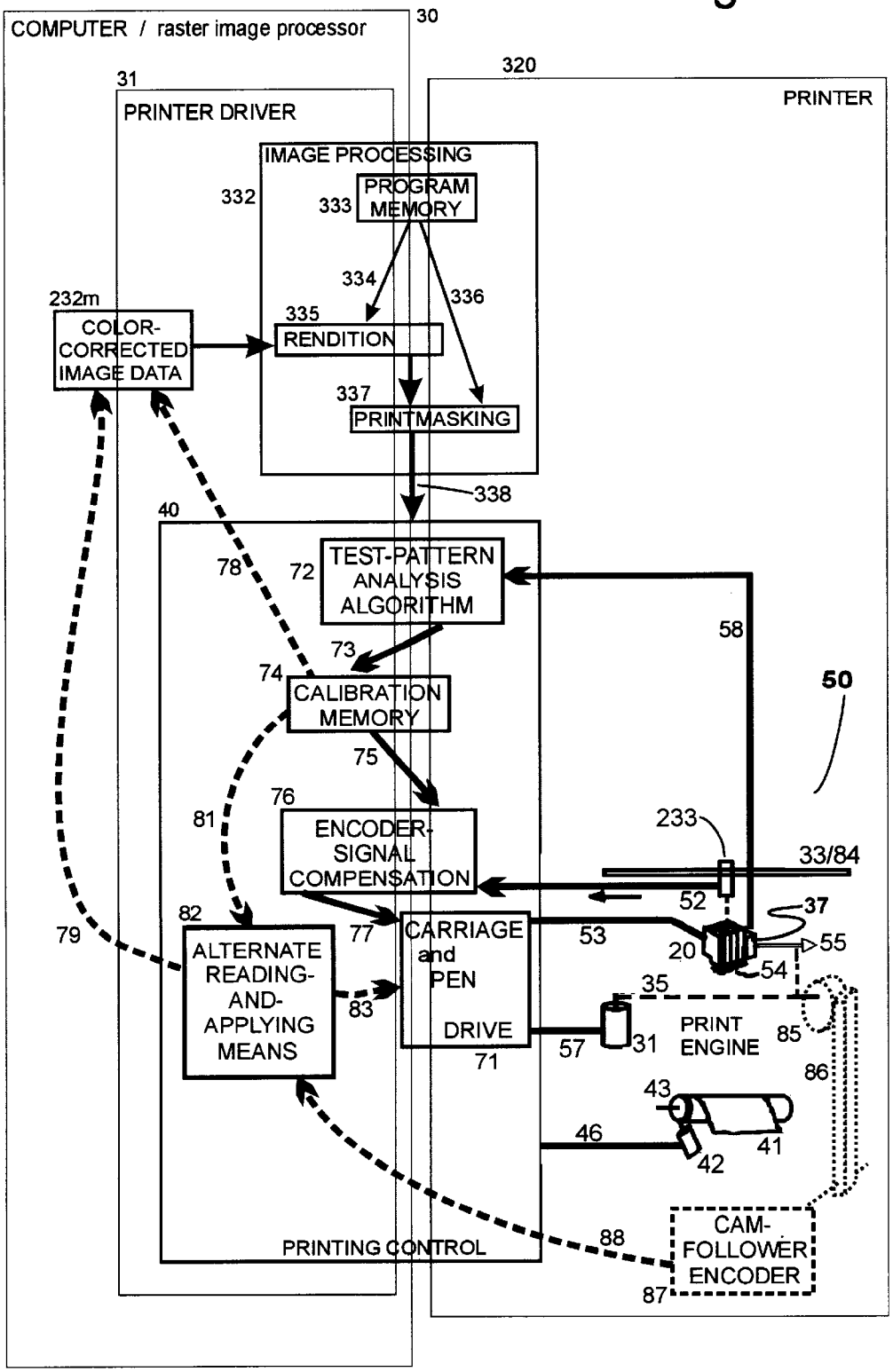
FIG. 19 is a highly schematic block diagram of the printer/plotter of FIGS. 1 through 10, particularly showing key signals flowing from and to one or more digital electronic microprocessors to effectuate printing.

The printing-control stage 40 necessarily contains electronics and program instructions for interpreting the colorant-per-pixel-per-pass information 338. Most of this electronics and programming is conventional, and represented in the drawing merely as a block 71 for driving the carriage and pen. That block in fact may be regarded as providing essentially all of the conventional operations of the printing control stage 40.

b. Alternative subsystems for effectuating the calibration—Also appearing in that stage 40, in FIG. 19, are many specific modules (and associated data-flow paths) 72–88 for use in implementing the calibration of the present invention. It is very important to note that certain of these illustrated specific functions are alternatives, rather than subsystems that would typically coexist within any single printer/computer/RIP system.

The printing-control stage 40 includes a calibration-data memory 74, but does not necessarily include any facility for deriving or storing the calibration data, since that can be done and the results retained in suitable memory before the printer leaves the factory. It is quite acceptable, however, to include automatic self-calibration capabilities in the machine when shipped, so that new calibration can be performed in event of chassis-component damage or replacement, or other cause for doubt.

Figure 16:
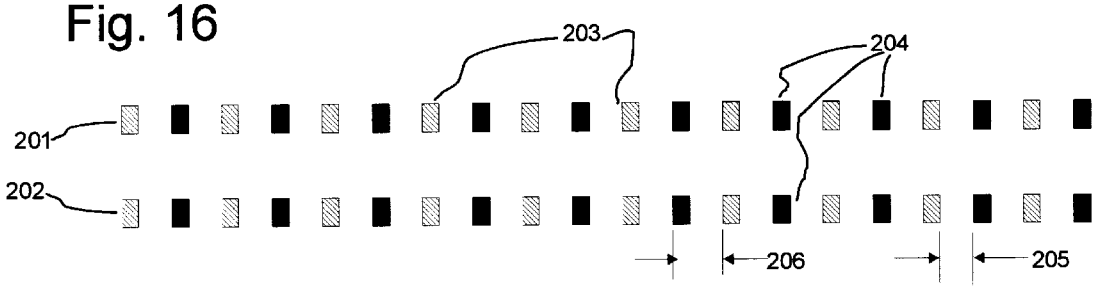
FIG. 16 is a representation of an alternating-block test pattern printed with a printer/plotter, and for use in developing a calibration, according to the present invention.
Figure 17:
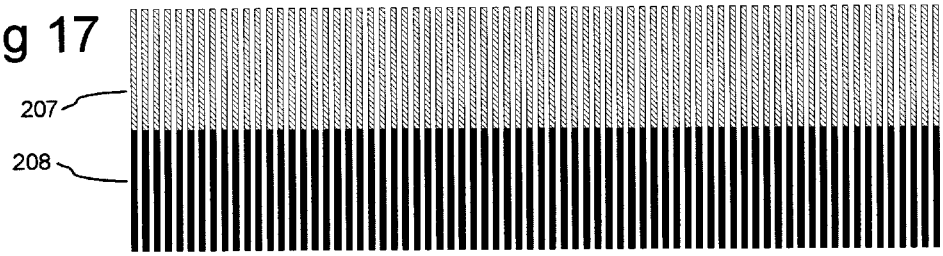
FIG. 17 is a representation of a split-bar test pattern similarly printed, and for use in alternative calibration-developing procedures, according to the invention.

Such facilities include capability to cause the print engine 50 to print a test pattern (FIG. 16 or 17). They also include an algorithmic block 72 for reading and analyzing the test-pattern data 58 as described in the preceding sections, and storing the resulting calibration information 73 in the calibration memory 74.

c. Small, digital memory—The calibration memory can take a number of different of forms (FIG. 20), and its contents can be put to use in perhaps an even great number of different ways (FIG. 21). The more preferred forms of this memory are those which are more practical, economic, and convenient. As mentioned previously, the most highly preferred forms of the invention include a small digital electronic or optical memory 274 (FIG. 20) that holds one or several bytes of offset data.

Those data may be simply a small number (such as one) of constant offset values - given for example by the calculated differential Double-$Z_{diff.}$ discussed in subsections 2e–g above. As suggested in the sketch, since the calibration correction is small and the dynamic range of the Double-$Z_{diff.}$ values correspondingly small, the memory 274 need hold only a very small number of binary bits.

When the calibration memory 74 takes such a form 274, implementation of the "alternate reading-and-applying means" 82 (FIG. 19) naturally take the complementary form of means 127 for applying the stored offset value to the interpen alignment. This function includes storing the adjusted interpen-alignment values in the memory reserved for the interpen alignment.

d. Custom codestrip—Another type of memory 74 is essentially photolithographic or photographic, and can be used to provide a customized encoder strip 84 (FIG. 20) for an individual printer. Graduations or indicia 91 of the codestrip 84 may be uniformly spaced in some regions of the strip, but as shown may be compressed in other regions 92 and expanded in yet other regions 93.

These spacing variations are computed to reflect the effective, or apparent, lengthening and contraction of the rod segments that is actually an artifact of the varying relationship between encoder reading and actual pen travel. That varying relationship is explained in the informal introduction portion of the SUMMARY OF THE DISCLOSURE section in this document.

The codestrip is custom-formed photographically or photolithographically, with the computed spacings, to compensate for rod-straightness deviations by providing signals 52 that are essentially linear in actual travel of the printheads 23–26 relative to the true (straight) scan axis. When signals 52 from an encoder 233 having such a strip 84 are received in the printing-control stage 40, they require no further compensation and are simply read 126 and used directly in the conventional and traditional fashion.

Besides differing radically from the digital memory circuit 274 in physical form, the custom codestrip 84 also differs in a conceptually more fundamental way. The codestrip provides compensation that varies in a nearly continuous way along the operating span of the carriage.

Rather than compensating with a single offset value that strikes a good compromise over the whole carriage stroke, the custom strip 84 thus is able to compensate much more precisely at each point of that stroke. Furthermore it does so independent of carriage velocity, inkdrop speed in flight, and other operating parameters.

e. Mechanical or electromechanical compensator—A considerably more costly type of memory 74 is a mechanical cam 85 (FIG. 19) driven from the carriage-motor shaft 35. The cam operates a cam follower 86, which in turn drives a special cam-follower encoder 87.

The cam is formed or mounted, or both, to provide a signal 88 from the cam-follower encoder 87 which is related to the known nonlinearity of the carriage-position encoder signal 52 with actual travel of the carriage along the ideal scan axis. In the drawing the cam-follower encoder signal 88 is seen passing to the alternate reading-and-applying means 82.

The cam 85, follower 86 and encoder 87 considered together, however, are simply a special case of a calibration memory 74. Recognizing this fact, it may be helpful to conceptualize the signal alternatively as passing along a path 81 from that memory 74 to the alternate reading-and-applying means 82.

In any event, when the cam-follower encoder signal reaches those means 82, it can be used in any of several different ways that will be described in subsections 4h–n below. Like the custom codestrip discussed earlier, the cam approach enables substantially continuous correction, if desired, over the entire carriage stroke.

f. Custom compensation circuit—Another form of memory 74 that is within the scope of the invention is a circuit 88 (FIG. 20) containing an analog compensation network 95. This strategy to permits correction over the entire carriage stroke, but depending on the type and complexity of the compensation circuit the correction may be either continuous or in effect interpolated between discrete points along the rod—or stepwise within discrete segments of the rod.

The network is, for example, placed in a feedback loop 96 of an amplifier 97. The network 95 if desired includes delay elements or active components.

It is designed to receive the carriage-encoder signal 333, preferably with the counts converted to an analog form, and in response develop a modified or compensated signal 98 that is approximately linearized with respect to carriage travel along the scan axis. This design follows the well-known principles of compensation networks, in conjunction with the known deviations of the particular support/guide rod 34 in the printer where the network 95 will be installed.

The compensated encoder signal 98, preferably redigitized, proceeds 81 to the alternate reading-and-applying means 82. There it can be used in ways described in subsections 4h–n.

g. Polynomial coefficients—Another form of memory 74 that customizes the printer response to the encoder signal 52 is a digital memory 89 (FIG. 20) for storing custom coefficients of a polynomial. This form of the memory is for treating the encoder counts 52 as a digital signal S.

The system evaluates the polynomial with the stored coefficients to derive an adjusted signal $S_{adjusted}$. This compensated digital signal—which may be roughly linear in actual carriage travel relative to the scan axis, or for some purposes may instead be related to the nonlinearities of the carriage-encoder signal 52—is directed to the reading-and-applying means 82 for use as described below. The polynomial may be evaluated on a pixel-by-pixel basis, or for each individual encoder-count position (in principle possible but requiring extremely high computation speeds) or it may be evaluated at milepost positions, and interpolated between those positions or simply stepped from segment to segment of the rod.

h. Encoder-signal compensation—Each of the memory types introduced in subsections 4e–g above can be used in a variety of ways. One way already suggested above is to direct the memorized data 75 (FIG. 19) to a circuit 76 that also receives the raw carriage-encoder signal 52 and suitably combines the two to form a compensated carriage-encoder signal 77. This signal may be adjusted accurately for every encoder-count position, or the adjustment may be interpolated or stepped between selected rod positions.

Figure 20:
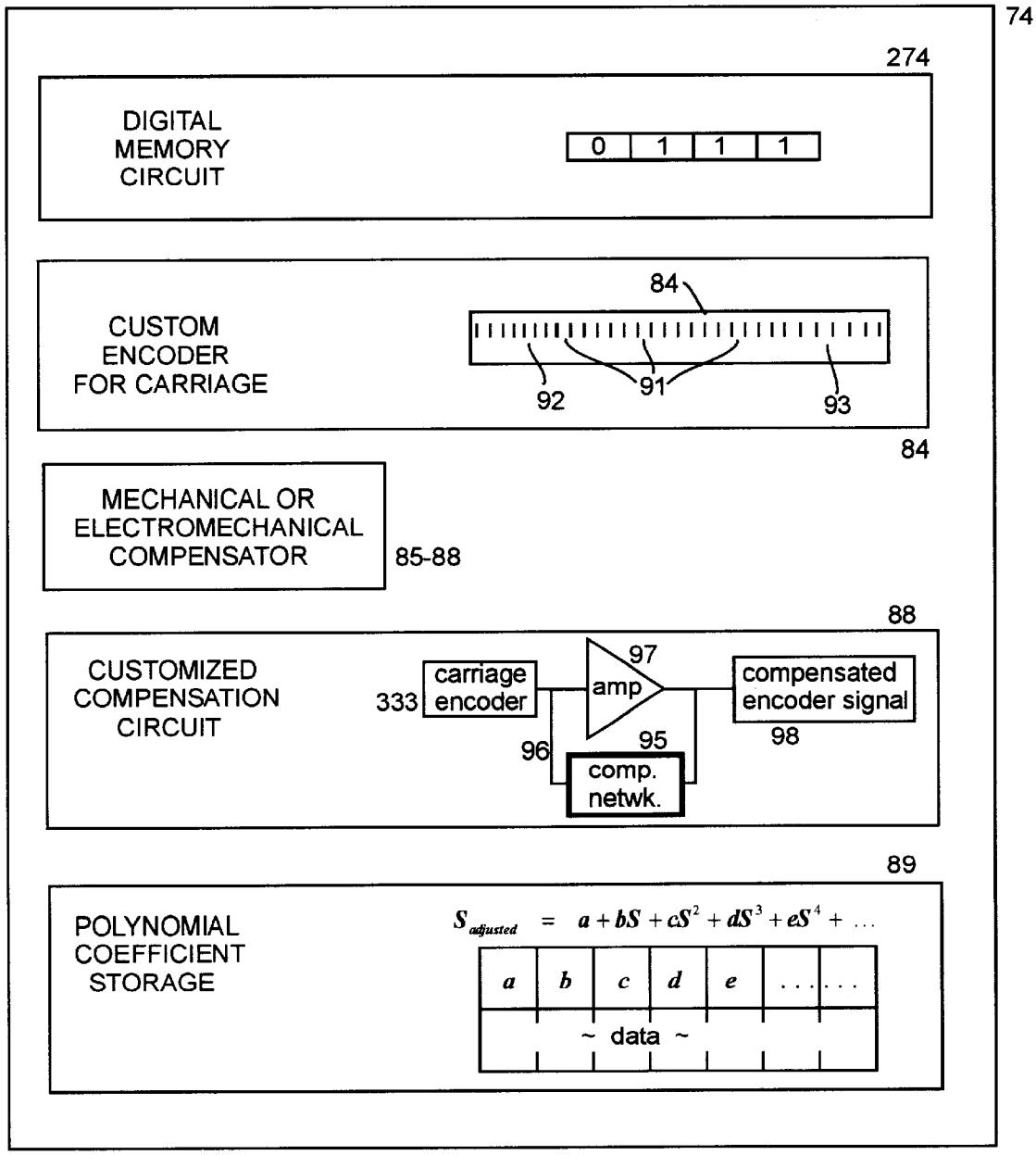
FIG. 20 is a memory device, particularly including a group of alternative such devices, for use in the FIG. 19 system.
Figure 21:
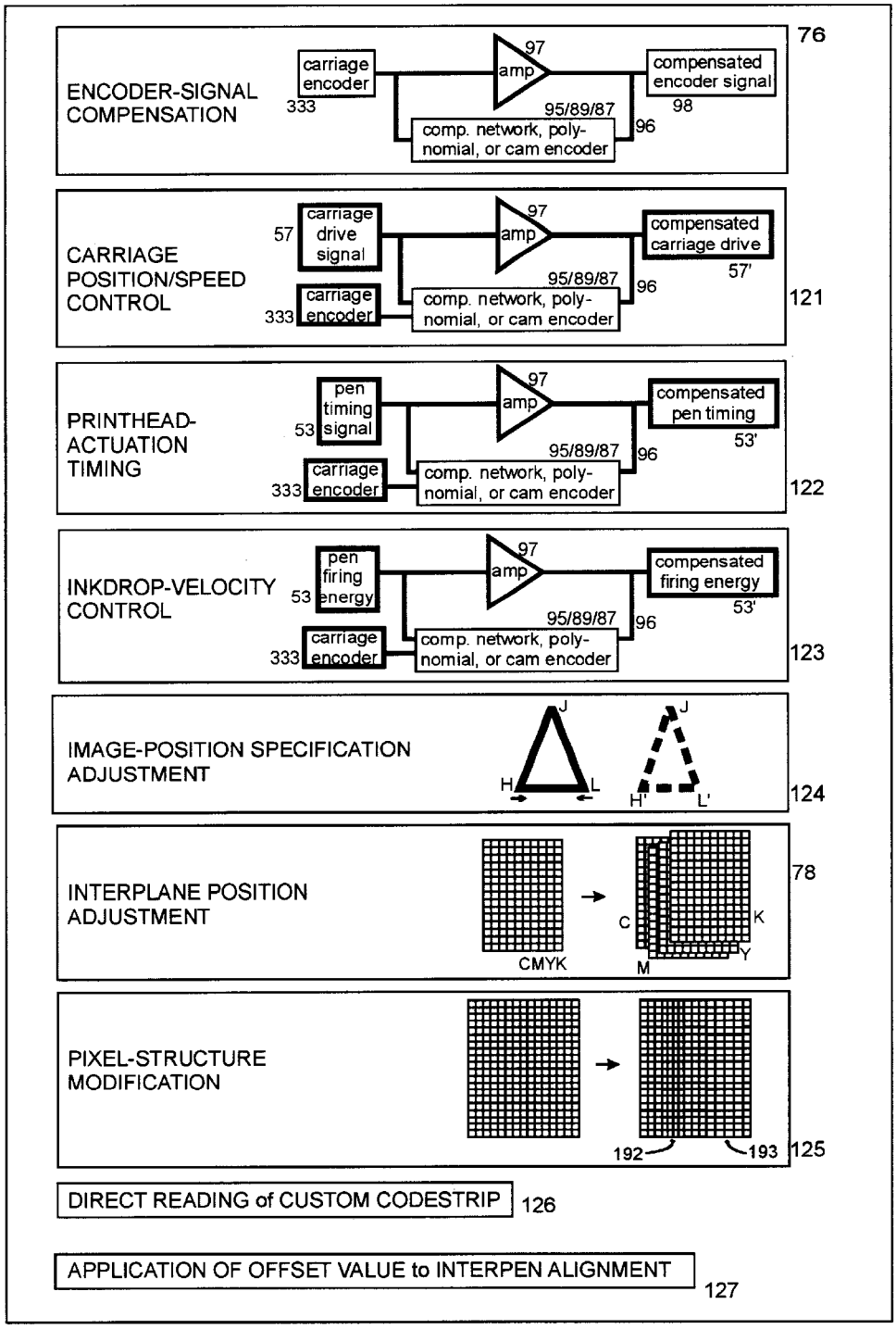
FIG. 21 is a showing of reading-and-applying means, also including a group of alternative such means and also for use in the FIG. 19 system.

Modification of the carriage-encoder signal in the circuit 76 is preferably performed digitally, but in purest principle may be analog-based as suggested at 88 in FIG. 20 and at 76 in FIG. 21. In either event the modification is performed in such a way that the compensated signal 77 mimics as closely as practical an uncompensated signal in a printer having a perfectly straight support rod 34.

The compensated encoder signal 77 then proceeds to the carriage and pen drive 71. There it is used exactly as the drive 71 would use an uncompensated signal in a printer with a straight rod 34.

i. Carriage position/speed control—A converse approach is to use the network, polynomial or cam-follow-er-encoder signal output to modify the operation of some other component of the print engine 60. This is done in such a way as to neutralize the nonlinear effects of the rod 34—again continuously, interpolated or stepped.

For this purpose the signal path 75 (FIG. 19) from the memory to the compensation module 76 is not used. That compensation block 76 is therefore inactive (in reality absent), and the encoder signal 52 passes 77 substantially unchanged to the carriage and pen drive 71.

The memorized data 81 or their effects 88 are instead provided to the alternate reading-and-applying means 82, which applies them 83 to the carriage and pen drive 71 in a compensatory strategy. For example, within that drive circuit 71 the signal 57 for moving the carriage may be adjusted—in response to the applied compensation signal 81, 88.

The circuit 71 develops modified carriage drive signals 57' which compensate in operation of the carriage drive motor 31 for the known effects of rod deviations. Thus carriage position or speed, or both, are subjected to control 121 (FIG. 21) which linearizes operation of the carriage despite the rod effects.

As in the general schematic of FIG. 19, each alternative module 121–123 (FIG. 21) includes subcomponents which are not necessarily all present in any given embodiment of the respective illustrated form of the invention. For instance if the memory 95/89/87 (FIG. 21) takes the form of a carriage-drive cam 85, follower 86 and encoder 87, then a redundant input from the carriage encoder 333 is not required.

j. Printhead-actuation timing—According to yet another compensation strategy, the drive circuit 71 (FIG. 19) instead adjusts the signal 53 for timing of colorant deposition. As in the carriage-signal case, this modification is in response to the applied compensation signal 81, 88, and the correction may be continuous or otherwise.

The circuit 71 generates versions of the printhead-firing signals that are modified with respect to the timing of inkdrop ejection or whatever other colorant-deposition mechanism is applicable. In an inkjet printer this can be accomplished by varying the timing based upon positions of the individual nozzle columns respectively.

In this way the deposition of colorant is subjected to control 122 (FIG. 21) which linearizes the operation of colorant-depositing devices. This linearization is effective despite rod deviations—and also despite maintenance of unchanged carriage positioning and speed.

k. Inkdrop-velocity control—In still another alternative strategy the drive circuit 71 adjusts the signal 53 for rapidity of colorant deposition. As before the adjustment may be made continuous or not, relative to carriage position. Here, in response to the applied compensation signal 81, 88 the drive circuit generates versions of the printhead-firing signals that are modified with respect to the velocity of inkdrop propagation from pen to paper—or, more generally, the response speed of whatever colorant deposition mechanism is employed.

Again, deposition of colorant is subjected to control 123 that linearizes operation of colorant-depositing devices notwithstanding rod deviations, maintenance of carriage position and speed, and even the timing of colorant deposition. In an inkjet printer this can be accomplished by varying the firing energy directed to the pens, based upon positions of individual nozzle columns respectively.

1. Image-position specification adjustment—Where-as the above-discussed reading-and-applying means look to the print engine for intervention points where compensation can be performed, other strategies according to the present invention turn about and look to the image data 232 (FIG. 19) and its preliminary processing. (Variants that intervene within the rendition and printmasking stages 335, 337 are equivalent.) These embodiments too can be implemented on either a continuous, interpolated or stepped basis.

Like the print-engine intervention modules 76, 121–123 (FIG. 21), the modules 124, 78, 125 representing these image-intervention embodiments may require input from the carriage encoder 333 as well as the memory 74, 87, 89, 95. For convenience of illustration, however, these carriage/memory inputs are omitted from the module 124, 78, 125 illustrations, which focus instead on the graphical characteristics that are affected.

If a simple offset calibration is to be employed, the offset data are passed 78 in a relatively straightforward fashion from the calibration memory 74 to the image-data array 232. Since the correction distances are typically a fraction of a pixel column, in this case the adjustment requires interpolation of all the image data points, effectively shifting the image by a fraction of a column leftward or rightward to redistribute the DPE effects as discussed earlier.

For bitmap images, such a shift is indistinguishable from modifying the structure of the pixel grid itself. This is discussed in section 4n below.

For vector graphics even a stepped, interpolated or continuous correction is made straightforward by the character of the image data. If for example a large geometrical FIG. 124 (FIG. 21) to be printed has three nodes H, J, L, and two of these nodes H, J will fall in rod segments that have significant straightness deviations, the system is instructed to displace those nodes H, J while leaving the remaining node J undisturbed. These displacements are simply by the same offset magnitudes, but opposite in sign, as the expected rod-produced errors.

Thus if it is known that rod deviation will cause one node H to be moved leftward and the other node J rightward, the vector data are moved rightward for the first node H and leftward for the other node J, as illustrated by the adjacent small arrows in the solid-line figure. Resulting nodes in the virtual image thus produced are H' (to the right of the original first node H) and J' (to the left of the other original node J).

The term "virtual" is used to suggest that ordinarily the image as modified appears nowhere—neither on the computer screen nor in the final printout. Its existence is limited to its manifestation within the data file.

The geometrical figure in the virtual image is therefore, in this case, narrower—as shown in the broken line. After printing, however, because these displacements are reversed by the deviations in the chassis, the figure appears restored to its correct original shape.

m. Interplane position adjustment—A calibration paradigm that is intermediate in complexity between single-offset and a stepwise variation along the rod length is a group of interplane offsets, or in other words relative displacements of the image components respectively formed by the various printheads. Most typically, though not necessarily, these are different colors—or different intensity/color combinations, in printers that operate with plural dilutions of one or more colorants.

Though not as effective as a position-varying compensation, such interplane adjustments enable independent optimization for each plane. The result is a more-precise correction than possible with only a single offset.

Since an interplane position adjustment is slightly more complicated than a single-offset procedure, it may be helpful to conceptualize the calibration data for the interplane adjustment as first following a path 81 from the calibration memory 74 to the alternate reading-and-applying means 82. Those means 82 process the calibration data to prepare those data for use in modifying the image data 232. The processed data 79 then pass to the image-data module 232 and there modify the image data.

For example suppose it is known that in a particular printer, and with particular installed printheads, over the whole stroke of the carriage the best position of the magenta plane is to the left of the best position of the cyan plane. To correct this, the magenta plane is deliberately shifted 124 (FIG. 21) to a virtual position M rightward from the cyan plane C. (As the drawing suggests, interpen vertical adjustments too—i.e., x-axis shifts—can be provided through this procedure.)

Similarly as illustrated the virtual yellow plane Y may be positioned (only as an example) rightward from the magenta plane, and the virtual black plane K may be still further rightward. After printing, the average positions of the planes will be shifted by the rod deviations back toward a closer four-way mutual alignment—thereby minimizing the errors over the full span of the carriage. Individual features of different colors, however, may be misaligned more severely in the final printout.

Those skilled in this field will now recognize that certain of the reading-and-applying means of the present invention can be used together. For example the interplane alignments described here can be implemented in combination with straightness adjustments varying along the rod 34—whether continuous, interpolated or stepped. Such combinations may also be enhanced by x-axis measurements for mechanical interhead alignment.

n. Pixel-structure modification—As mentioned earlier, in a simple offset calibration the offset data are passed from the calibration memory 74 to the image-data array 232. Typical fractional-pixel-column adjustments require interpolating all image points to shift the entire image by a fraction of a pixel column.

Thus even a relatively simplified means of compensation, one that implements a single offset for all colors and all carriage positions, may require massive computation for full-bitmap images. This manipulation is not prohibitive, particularly if it can be performed offline—that is, performed in the background by a multitasking computer, before rather than during actual printing.

Computation may be made significantly less onerous for run-length-encoded data, since the number of points specified—and therefore the number to be shifted—is smaller. (For most vector data the number of points to be shifted is even smaller, and these means of computation are quite practical as discussed in subsection 4-l above.)

For systems in which severe straightness deviations make a single-offset calibration inadequate, as previously noted a calibration that varies along the length of the carriage stroke can still eliminate perceptible DPE effects. Within limits, this approach offers extremely favorable economics, as it enables remarkable loosening of rod-straightness specifications.

For segments of the rod 34 where deviations tend to cause an effective horizontal expansion of the printed pixel grid, the corresponding portions 192 (FIG. 21) of the virtual grid can be selectively precompressed as illustrated. Conversely where deviations tend to cause horizontal compression or contraction of the printed grid, the corresponding portions 193 of the virtual grid can be selectively preexpanded as also shown.

When the image is printed, the preadjustments and the deviation-induced artifacts cancel each other, and the actually printed grid is thereby linearized. The linearization is relatively inaccurate if stepped preadjustments are applied to various segments of the rod, relatively more accurate if interpolated preadjustments are used, and most accurate if preadjustments are substantially continuous in their variation along the rod. Different adjustments can be applied for respectively different color planes if still further accuracy is desired.

5. Method

Figure 22:
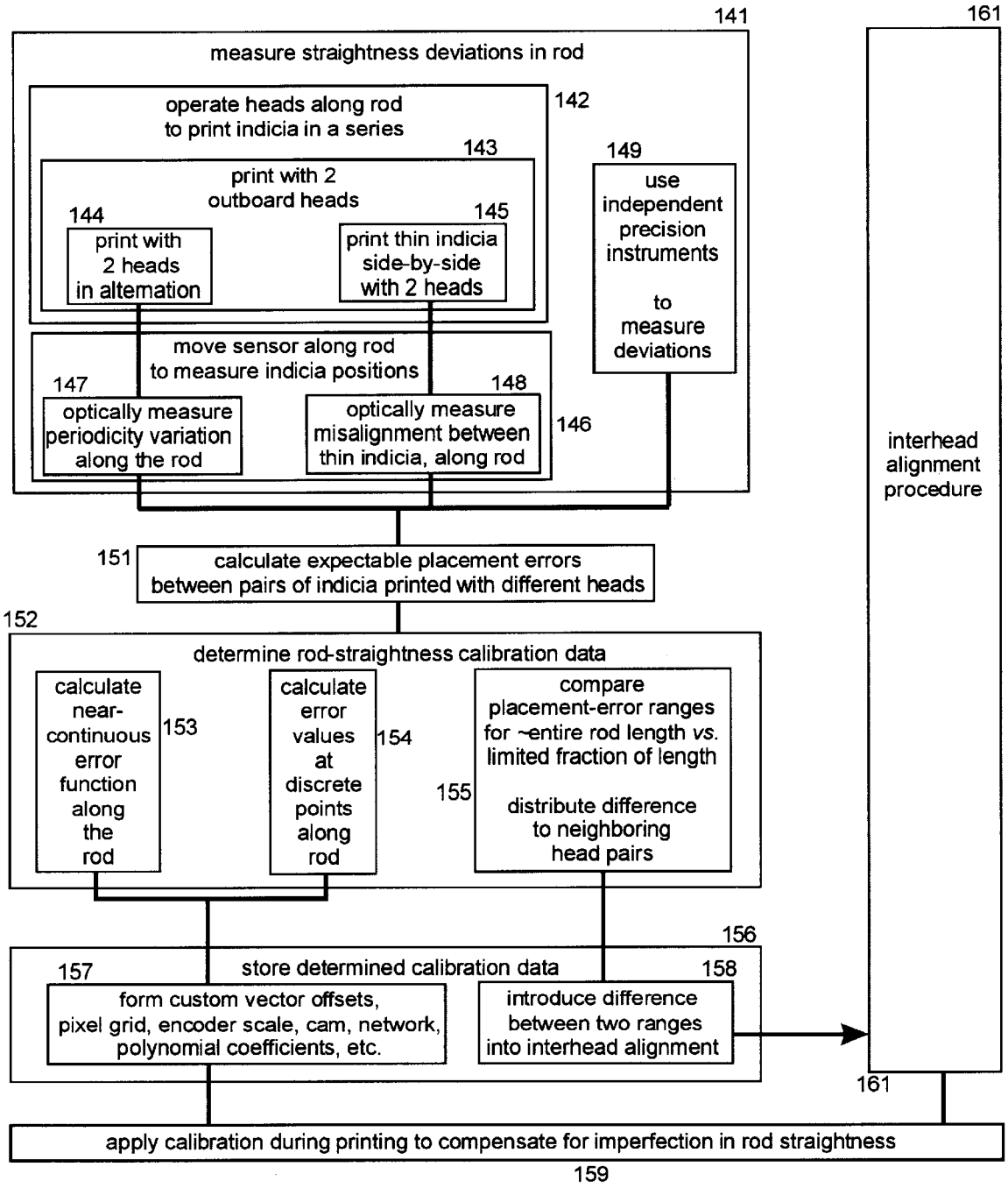
FIG. 22 is a flow chart showing method features of the invention.

In certain of its preferred embodiments, the novel calibration procedures 141–158 (FIG. 22) of the present invention operate in parallel with a procedure 161 for aligning plural printheads with one another. That interhead alignment 161 relies on measurements taken within a relatively short part of the carriage stroke—as well-documented by Cobbs and Sievert, whose descriptions are incorporated by reference here. If a single-offset calibration is adopted, the results of that effort are typically handed off to the interhead alignment 161 as shown near the bottom of the diagram.

The novel procedures of the present invention are also capable of use alone, particularly in printer products not already provided with short-span interhead alignment as an essentially permanent design feature. In such situations the calibration procedures outlined in this document are amenable to integration with interpen alignments (see e.g. subsection 4 m above).

Calibration according to preferred embodiments of the invention includes the major steps of straightness-deviation measurement 141, expected-error calculation 151, and finally calibration-data determination 152 and storage 156. Associated during later printing operation is a calibration-data retrieval-and-application step, to at least reduce the effects of rod-straightness imperfections.

Details of these major steps have been presented earlier. Thus foregoing sections of this document make clear that the straightness measurement 142 can be performed as a shop-instrument procedure 149, or by printer self-test steps of printing 142 and measuring 146 indicia along substantially the image span of the rod.

The printing step 142 is preferably performed by use 143 of only the two outboard heads. If the two-head-alternating mode 144 is chosen for printing—to create a series of alternating color blocks as noted earlier—a complementary periodicity measurement mode 147 is preferably chosen for measurement; conversely if the split-bar mode 145 is chosen for printing, then the misalignment mode 148 is preferable for measurement.

In the calibration-data determination 152, most typically the previously discussed comparison 155 of entirerod error statistics with fraction-of-rod error statistics is associated with the single-offset storage step 158. This step, as noted above, essentially hands off the single offset value for use in the interhead alignment.

Near-continuous error function calculation 153 is illustrated as an alternative to discrete-point error calculation 154. As explained previously the use of discrete values is itself preparatory to either stepwise variation or interpolated variation, along the rod, of the correction offset values. Any of these variation styles can be implemented by any of the multivalue storage options 157.

The above disclosure is intended as merely exemplary, and not to limit the scope of the invention—which is to be determined by reference to the appended claims.

What is claimed is:

1. Apparatus for printing desired images on a printing medium, by construction from individual marks formed in pixel column-and-row arrays; said apparatus comprising:

at least one printhead for marking on the printing medium;

a carriage holding the printhead;

a rod supporting the carriage for scanning motion across the printing medium;

a printing-medium advance mechanism for providing relative motion between the printhead and printing medium along a direction substantially orthogonal to the rod;

a memory for storing rod-straightness calibration data; and means for reading from the memory, and applying, the rod-straightness calibration data to compensate in operation of the printhead for imperfection in straightness of the rod.

2. The apparatus of claim 1, further comprising:

an encoder for determining position and speed of the carriage.

3. The apparatus of claim 2, wherein:

the printhead and encoder are at respective opposite sides of the rod.

4. The apparatus of claim 1, wherein the rod has a length; and further comprising:

a substantially single offset value stored in the memory for use in compensating operation of the printhead along substantially the entire length of the rod.

5. The apparatus of claim 4, wherein:

the single offset value equals in magnitude the effect upon dot-placement error of a median departure of the rod from straightness, along substantially the entire length of the rod.

6. The apparatus of claim 4, wherein:

the single offset value equals in magnitude the effect upon dot-placement error of an average of maximum and minimum departures of the rod from straightness, along substantially the entire length of the rod.

7. The apparatus of claim 4, wherein:

the single offset value is approximately equal in magnitude to the effect upon dot-placement error of a weighted composite of:

a median departure, and an average of maximum and minimum departures of the rod from straightness, along substantially the entire length of the rod.

8. The apparatus of claim 1, further comprising:

plural offset values stored in the memory for use in compensating operation of the printhead within respective segments of the rod.

9. The apparatus of claim 8, further comprising:

means for interpolating between the plural offset values.

10. The apparatus of claim 8, wherein:

the at least one printhead comprises plural printheads; and each of the offset values is substantially an average of offsets of the plural printheads, as compared in position with the sensor.

11. The apparatus of claim 1, wherein the rod has a length; and further comprising:

for each of at least one straightness dimension, a substantially continuous offset function stored in the memory for use in compensating operation of the at least one printhead along substantially the entire length of the rod.

12. The apparatus of claim 11, wherein:

the at least one printhead comprises plural printheads; and the offset function is substantially an average of offset functions for the plural printheads, as compared in position with the sensor.

13. The apparatus of claim 1, wherein:

the rod has a length;

the at least one printhead comprises plural printheads; and further comprising, for each of at least one straightness dimension and for each pair of the plural printheads respectively, data stored in the memory for use in compensating operation of the respective printhead along substantially the entire length of the rod; said data being selected from the group consisting of:

a respective separate substantially continuous offset function for each pair; and a respective offset value for each pair.

14. The apparatus of claim 1, wherein:

the at least one printhead comprises plural printheads; and the reading and applying means reduce undesired offset, due to said imperfection of straightness, between nominally aligned points printed with different ones of the plural printheads respectively.

15. The apparatus of claim 1, wherein the memory comprises means selected from the group consisting of:

an encoder for determining position and speed of the carriage, the encoder comprising a codestrip having indicia unequally spaced to compensate for the straightness imperfection;

an analog electronic or optical circuit formed or adjusted to compensate for the straightness imperfections;

a mechanical cam or linkage formed or adjusted to compensate for the straightness imperfections; and electronic storage of polynomial coefficients for approximating a function characterizing the straightness imperfections.

16. The apparatus of claim 1, wherein the reading and applying means comprise means selected from the group consisting of:

means for modifying signals from an encoder that reports position or speed, or both, of the carriage along the rod, to compensate for the straightness imperfections;

means for controlling position or speed, or both, of the carriage along the rod, to compensate for the straightness imperfections;

means for controlling timing of actuation of said marking by the printhead, to compensate for the straightness imperfections;

means for controlling velocity of propagation of said marking from the printhead toward the medium, to compensate for the straightness imperfections;

means for adjusting position specifications in image data to compensate for the straightness imperfections;

means for adjusting positional relationships between color planes in image data, to compensate for the straightness imperfections; and means for modifying pixel structure of image data, to compensate for the straightness imperfections.

17. A method of calibrating a scanning printer, which printer has plural printheads, and a printhead support-and-guide rod that is not perfectly straight, and which printer also has a memory for storing rod-straightness calibration data; said method comprising the steps of:

measuring straightness deviations in the printhead support-and-guide rod of the printer;

then, based upon the measured deviations, calculating expectable placement errors, along the printhead support-and-guide rod, between pairs of indicia printed with different printheads respectively;

then, based upon the calculated expectable placement errors, determining the rod-straightness calibration data; and then storing the determined rod-straightness calibration data in the memory of the printer.

18. The method of claim 17, wherein the measuring step comprises:

operating the plural printheads along the rod to print respective plural indicia in a series; and then moving a sensor along the rod to measure indicia relative positions.

19. The method of claim 18, wherein:

the operating step comprises printing the indicia with two printheads in alternation to provide an alternating series of indicia for the two printheads respectively.

20. The method of claim 19, for use with the printer having at least three printheads spaced along the rod; and wherein:

the operating step comprises printing the indicia with two of the three printheads that are furthest apart.

21. The method of claim 18, wherein the rod has a length; and for use in conjunction with a procedure for determining and compensating for interprinthead alignment, over a limited fraction of the rod length; and further comprising the step of comparing:

the range of placement errors within said limited fraction of the rod length, with the range of placement errors over substantially the entire rod length.

22. The method of claim 21, wherein:

the calibration-data determining step comprises introducing the difference between said two placement-error ranges into the interprinthead alignment.

23. The method of claim 22, wherein:

said difference-introducing comprises distributing the introduced difference as between alignment values for neighboring printheads.

24. The method of claim 18, wherein:

the operating step comprises printing nominally aligned thin indicia side-by-side with two printheads.

25. The method of claim 24, wherein:

the measuring step comprises optically measuring actual misalignment between the nominally aligned thin indicia.

26. The method of claim 17, wherein:

the measuring step comprises using independent precision measuring instruments to measure the deviations.

27. Apparatus for printing images on a printing medium, by construction from individual marks formed in pixel column-and-row arrays; said apparatus comprising:

an input stage receiving or generating an image data array for use in printing;

at least one printhead for marking on the printing medium;

a carriage holding the printhead;

a rod supporting the carriage for scanning motion across the printing medium;

a printing-medium advance mechanism for providing relative motion between the printhead and printing medium along a direction substantially orthogonal to the rod;

a memory for storing rod-straightness calibration data; and means for reading from the memory, and applying, the rod-straightness calibration data to modify the image data array to compensate in operation of the printhead for imperfection in straightness of the rod.

* * * * *